US009752841B2

(12) United States Patent
Lipowski

(10) Patent No.: US 9,752,841 B2
(45) Date of Patent: Sep. 5, 2017

(54) TRIGGER DEVICE

(71) Applicant: Trigger Tech, Mississauga (CA)

(72) Inventor: Mats Lipowski, Toronto (CA)

(73) Assignee: Trigger Tech (CA)

( * ) Notice: Subject to any disclaimer, the term of this patent is extended or adjusted under 35 U.S.C. 154(b) by 0 days.

(21) Appl. No.: 15/191,792

(22) Filed: Jun. 24, 2016

(65) Prior Publication Data

US 2016/0377363 A1 Dec. 29, 2016

Related U.S. Application Data

(60) Provisional application No. 62/184,073, filed on Jun. 24, 2015.

(51) Int. Cl.

| | |
|---|---|
| ***F41A 19/00*** | (2006.01) |
| ***F41A 19/10*** | (2006.01) |
| ***F41A 19/12*** | (2006.01) |
| ***F41A 19/16*** | (2006.01) |
| *F41B 5/14* | (2006.01) |

(52) U.S. Cl.

CPC ..... *F41A 19/10* (2013.01); *F41A 19/12* (2013.01); *F41A 19/16* (2013.01); *F41B 5/1469* (2013.01)

(58) Field of Classification Search

CPC ..... F41A 19/10; F41A 19/12; F41A 19/16; F41B 5/1469

USPC ..... 42/69.01, 70.04, 70.05, 70.06

See application file for complete search history.

(56) References Cited

U.S. PATENT DOCUMENTS

| | | | | | |
|---|---|---|---|---|---|
| 1,382,313 | A * | 6/1921 | Ortgies | F41A 19/12 | 89/145 |
| 2,156,191 | A * | 4/1939 | Pike | F41A 19/16 | 42/69.02 |
| 2,225,583 | A * | 12/1940 | Blizard | F41A 17/46 | 42/70.06 |
| 2,331,405 | A * | 10/1943 | Loomis | F41A 19/16 | 42/69.02 |
| 2,341,298 | A * | 2/1944 | Sweany | F41A 19/16 | 42/69.02 |
| 2,462,585 | A * | 2/1949 | Wesson | F61A 19/12 | 42/65 |
| 2,476,904 | A * | 7/1949 | Perry | F41A 9/60 | 42/106 |
| 2,549,904 | A * | 4/1951 | Hoard | F41A 19/16 | 42/69.02 |

(Continued)

FOREIGN PATENT DOCUMENTS

CA WO2013/138918 * 3/2013

*Primary Examiner* — Samir Abdosh

(74) *Attorney, Agent, or Firm* — Tarolli, Sundheim, Covell & Tummino LLP

(57) ABSTRACT

A trigger device for activating a firing mechanism, the trigger device comprising a housing, a trigger pivotally mounted on the housing via a trigger pivot pin, a sear arm comprising a first sear surface, a ticker extending generally from the trigger to the sear arm, the ticker pivotable about a ticker pivot pin, the ticker comprising spaced apart flanges, each of which comprises an aperture defining at least a first contact surface, and a captured roller positioned at least partially within the apertures, wherein in a captured position the first sear surface and the first contact surfaces engage the captured roller and in a released position the first contact surfaces disengage from the captured roller to allow the captured roller to move within the aperture.

20 Claims, 26 Drawing Sheets

(56) References Cited

U.S. PATENT DOCUMENTS

| | | | | |
|---|---|---|---|---|
| 4,908,970 | A * | 3/1990 | Bell | F41A 19/12 42/69.01 |
| 5,386,659 | A * | 2/1995 | Vaid | F41A 19/32 42/69.02 |
| 6,164,001 | A | 12/2000 | Lee | |
| 7,194,833 | B1 * | 3/2007 | Curry | F41A 19/12 42/14 |
| 7,325,539 | B2 | 2/2008 | Simo et al. | |
| 2014/0246003 | A1 * | 9/2014 | Lipowski | F41A 17/46 124/25 |
| 2016/0377363 | A1 * | 12/2016 | Lipowski | F41A 19/10 42/69.01 |

* cited by examiner

TRIGGER DEVICE

CROSS-REFERENCE TO RELATED APPLICATIONS

This application claims the benefit of U.S. Provisional Patent Application No. 62/184,073 filed on Jun. 24, 2015.

FIELD

The present invention relates generally to a trigger device and in particular to a trigger device for a firing device such as a firearm or a crossbow.

BACKGROUND

A firing mechanism is used to actuate the sequence of a firearm or crossbow by movement of a trigger. The trigger is generally activated by imposing a trigger pull load on the trigger, causing the trigger to move from a loaded position, at which the firing mechanism is activatable, to a released position, at which the firing mechanism is activated. As is well known, it is desirable for the trigger pull load to be predictable. For example, firing a firearm or crossbow is more accurate if the trigger pull load is consistent for the user.

There are competing factors to be taken into account in determining the trigger pull load required to pull the trigger. For example, if the trigger pull load is relatively large, inadvertent activation of the firing mechanism is unlikely thereby increasing safety of the firearm or crossbow. On the other hand, if the trigger pull load is relatively small, activating the firing mechanism is relatively easy thereby reducing the effect of activating the trigger on accuracy of the firearm or crossbow. Further, a small trigger pull load may increase the frequency at which the firearm can be activated.

Various attempts have been made to increase the accuracy of a firearm or crossbow. For example, U.S. Pat. No. 6,164,001 to Lee discloses a device comprising an independent trigger bow supplied with overlapping recess and a trigger block having a bow guide recess, pivot hole with axis pin, primary lever having an axis hole at one end and a bow extender recess and a trigger plate having a pre-load bar and stopper bar that can be assembled into a module to allow easy installation on trigger tunnel of firearm for reduce firearm trigger pull weight without altering firearm. The Block is equipped with catches extending sideways and adjacent with bow guide recess which will overlap with recess of bow to allow both the bow and block to occupy in one same area which allow anchoring against a bow tunnel end wall and supplied with magazine cut disposed on the upper left of block to allow for a magazine passage. As trigger plate is depressed with finger within a given point on trigger plate upon firing the finger force will be shifted directly into the adjustable preload bar and synchronizes into the outermost lever end at point of lever producing a high torque leverage which reduces firearm trigger pull weight or load force from the trigger bow energized from sear, hammer and hammer spring. The trigger plate being retained with pivot pin through retaining slot is supplied with plate bearing and bottom bearing will slide against a frame upper bearing and against s block plate bearing of block respectively, will function as an advancing global pivot point which will changed a rotational action of lever into a linear straight pull action to maintain firearm standard straight action and reducing the trigger pull weight.

As another example, U.S. Pat. No. 7,325,539 to Simo et al. discloses a mechanical release or trigger device including a body. A trigger forming a shaft is movably mounted with respect to the body. At least one caliper is mounted with respect to the body and operatively connected to the trigger. The caliper is movable between a closed position and an open position, in response to a movement of the trigger. A sleeve is rotatably mounted with respect to the trigger and movable along an axis of the shaft. At least one stop element can be mounted with respect to the shaft at a first end portion of the sleeve or a second end portion of the sleeve, to limit axial movement of the sleeve. In one embodiment wherein the sleeve is asymmetric, and operatively connected to activate another mechanism such as a safety or firing system, a bias element can be operatively connected to the sleeve to bias the sleeve towards a first rotational position.

Although various attempts have been made to improve the performance of a trigger in a firearm or crossbow, further improvements are desired. It is therefore an object at least to provide a novel trigger device.

SUMMARY

Accordingly, in one aspect there is provided a trigger device for activating a firing mechanism, the trigger device comprising a housing, a trigger pivotally mounted on the housing via a trigger pivot pin, a trigger biasing member configured to bias the trigger in a ready position, a sear arm comprising a first sear surface, a ticker extending generally from the trigger to the sear arm and rotatable about a ticker pivot pin, the ticker comprising spaced apart flanges defining a slot, the slot receiving a portion of the sear arm including the first sear surface, each flange comprising an aperture defining a first contact surface, and a captured roller positioned at least partially within the apertures and extending through the slot, the captured roller configured to selectively engage the first sear surface and the first contact surfaces.

In an embodiment, the trigger comprises a trigger arm positioned above the trigger pivot pin. The captured roller is configured to rotate and translate within the apertures when disengaged with the first contact surface. The trigger comprises a slot configured to hold a portion of the ticker. A biasing member biases the ticker in a same direction as a direction of travel of the trigger from a ready position to a fire position.

According to another aspect there is provided an adjustment mechanism comprising a feedback member comprising a plurality of wedge shaped projections on a first surface thereof, a threaded wedge screw threadably coupled to a housing, the wedge screw comprising a first end shaped to be received between neighbouring wedge shaped projections, and a spring connected at a first end to the feedback member on a surface opposite the first surface, the spring configured to be compressed or decompressed based on a direction of rotation of the threaded wedge screw, wherein the feedback mechanism provides feedback to a user each time the threaded wedge screw is repositioned between adjacent neighbouring wedge shaped projections.

According to another aspect there is provided a trigger device for activating a firing mechanism, the trigger device comprising a housing, a trigger pivotally mounted on the housing via a trigger pivot pin, a sear arm comprising a first sear surface, a ticker extending generally from the trigger to the sear arm, the ticker pivotable about a ticker pivot pin, the ticker comprising spaced apart flanges, each of which comprises an aperture defining at least a first contact surface, and a captured roller positioned at least partially within the apertures, wherein in a captured position the first sear surface and the first contact surfaces engage the captured roller and in a released position the first contact surfaces disengage from the captured roller to allow the captured roller to move within the aperture.

BRIEF DESCRIPTION OF THE DRAWINGS

Embodiments will now be described more fully with reference to the accompanying drawings in which.

DETAILED DESCRIPTION OF THE EMBODIMENTS

Figure 1:
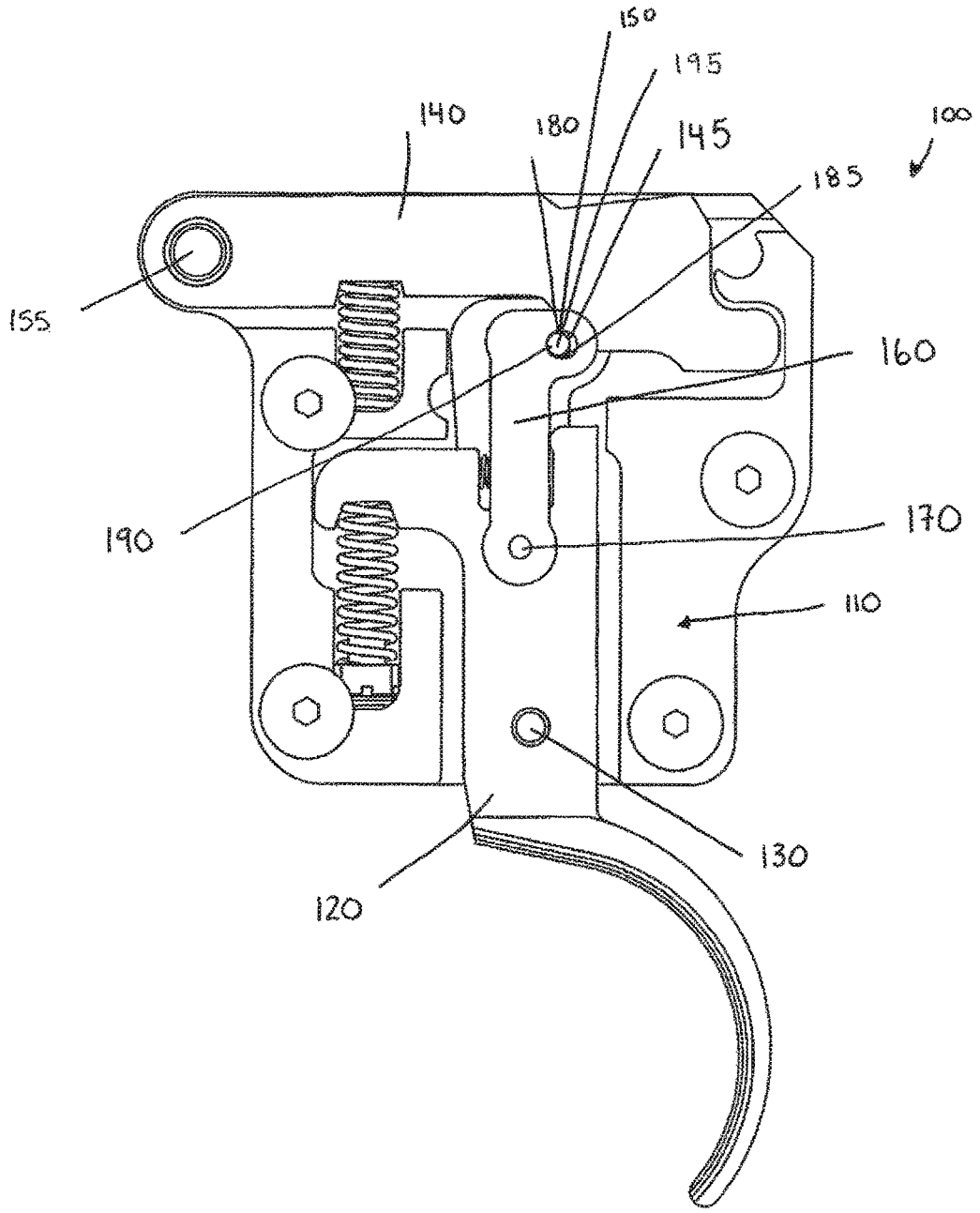
FIG. 1 is a cross-sectional view of a trigger device for activating a firing mechanism.
Figure 21:
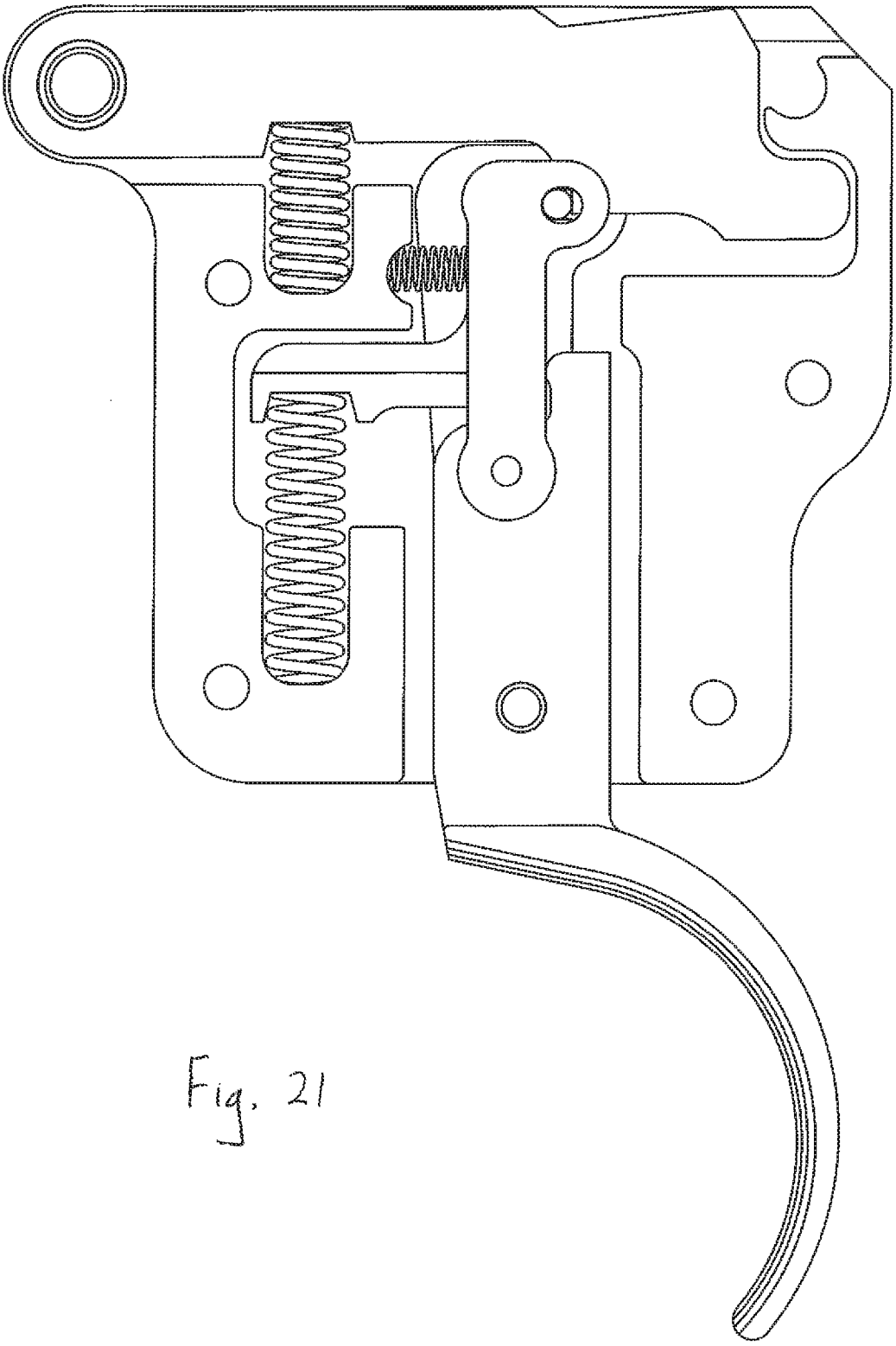
FIGS. 21 to 24 are cross-sectional views of trigger device of FIG. 16, showing different configurations of first and second surfaces of a sear.
Figure 22:
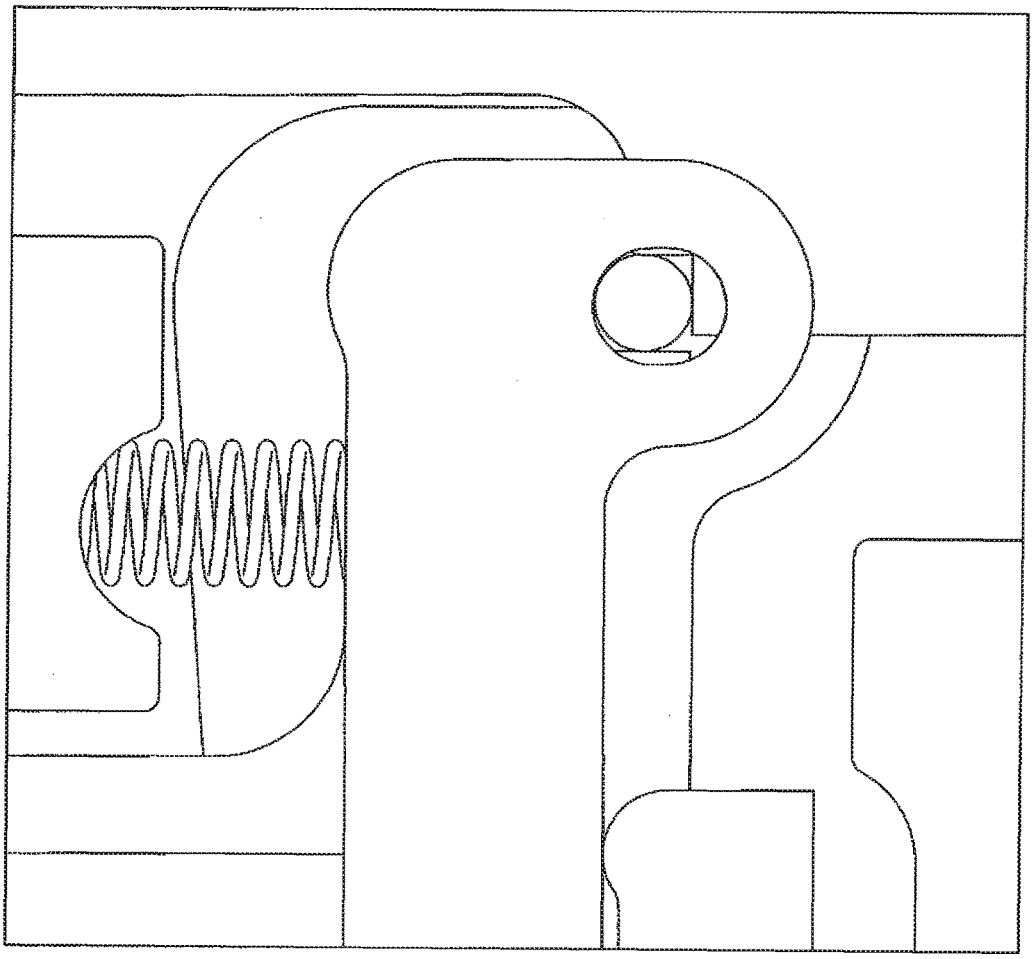
Figure 23:
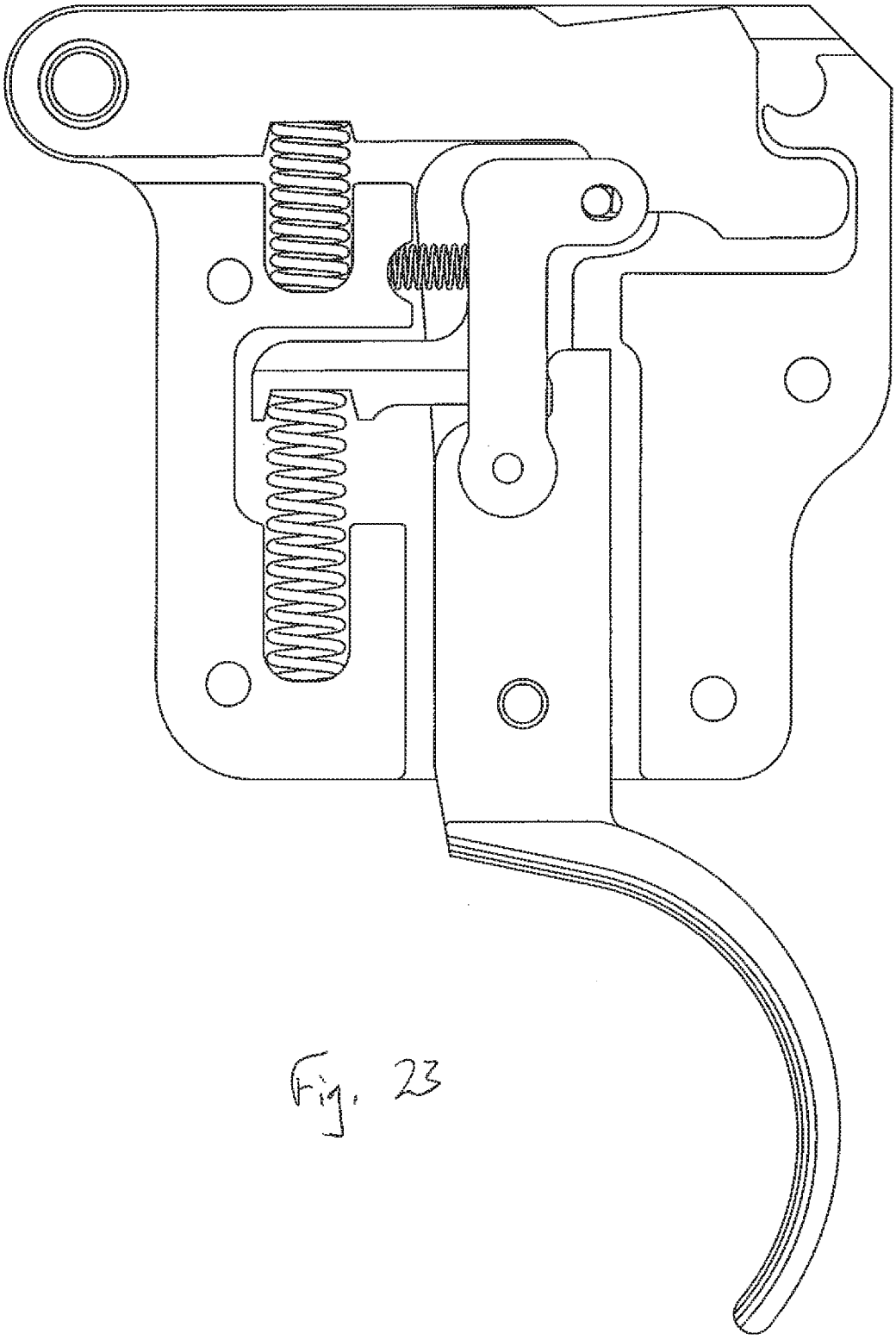
Figure 24:
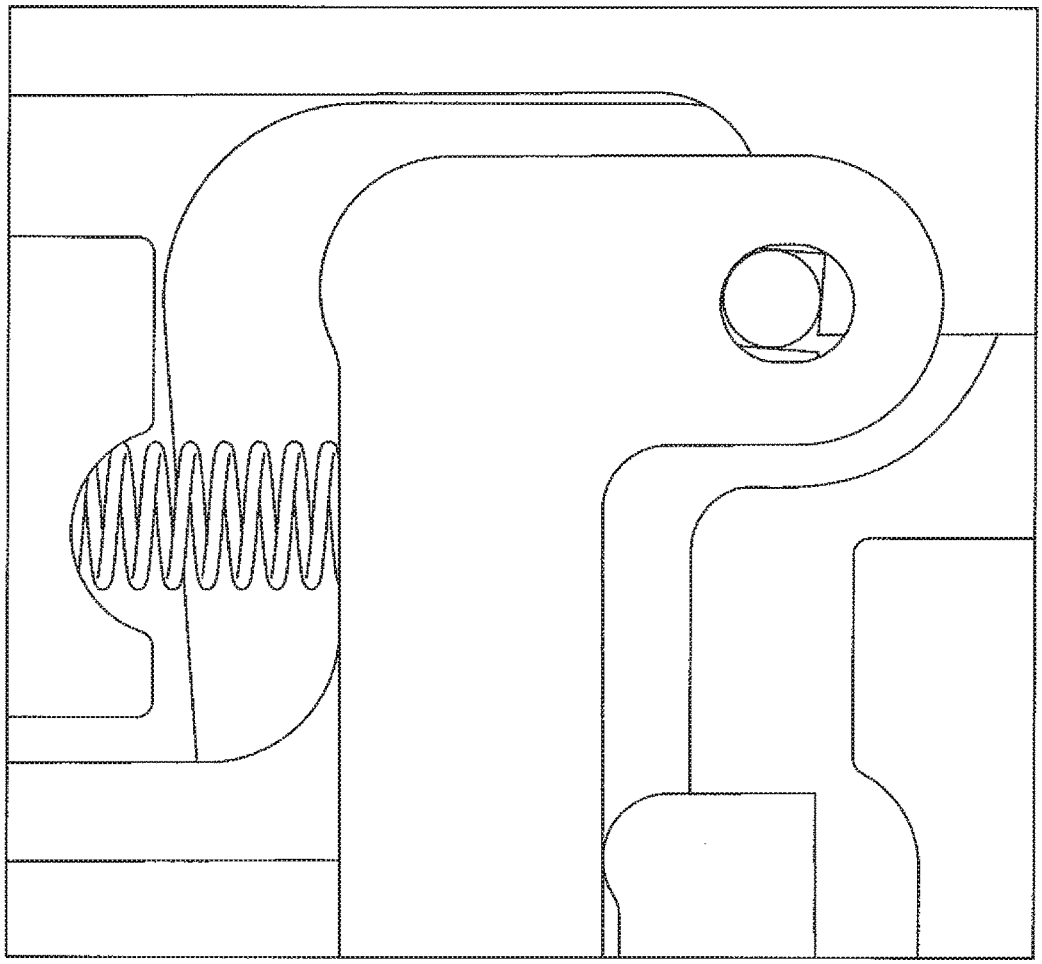

For convenience, like numerals in the description refer to like structures in the drawings. Referring to FIG. 1, a trigger device for activating a firing mechanism of a firing device illustrated generally by reference numeral 100. The trigger device 100 comprises a housing 110, a trigger 120, a trigger pivot pin 130, a sear 140, a sear pivot pin 155, a ticker 160, a ticker pivot pin 170, and a roller 195. The sear 140 comprises a sear arm aperture configured to receive the sear pivot pin 155. The sear 140 further comprises a first sear surface 145 and a second sear surface 150 located distal from the sear arm aperture. The first sear surface 145 and the second sear surface 150 are substantially v-shaped. For example, as illustrated in FIGS. 21 and 22, the first and second sear surfaces 145 and 150 may be substantially perpendicular to each other. As another example, as illustrated in FIGS. 23 and 24, the first and second sear surfaces 145 and 150 may be form an angle less than 90 degrees. Yet further, although not shown, the first and second sear surfaces 145 and 150 may be form an angle greater than 90 degrees.

The ticker 160 comprises a ticker aperture configured to receive the ticker pivot pin 170. The ticker 160 further comprises a roller aperture 180 defining a first contact surface 185 and a second contact surface 190. The ticker aperture and the roller aperture 180 are located proximate opposite ends of the ticker 160.

The trigger 120 is pivotally mounted on the housing 110 via the trigger pivot pin 130. The sear 140 is pivotally mounted on the housing via the sear pivot pin 155. The ticker 160 extends generally from the trigger 120 to the sear 140. The ticker 160 is pivotally mounted on the trigger 120 via the ticker pivot pin 170 at a position above the trigger pivot pin 130. The roller 195 is positioned within the roller aperture 180 of the ticker 160 and is configured to engage the first and second sear surfaces 145, 150 and the first and second contact surfaces 185, 190.

The housing 110 is configured to be attached to a firing device such as a firearm or crossbow (not shown).

Figure 2:
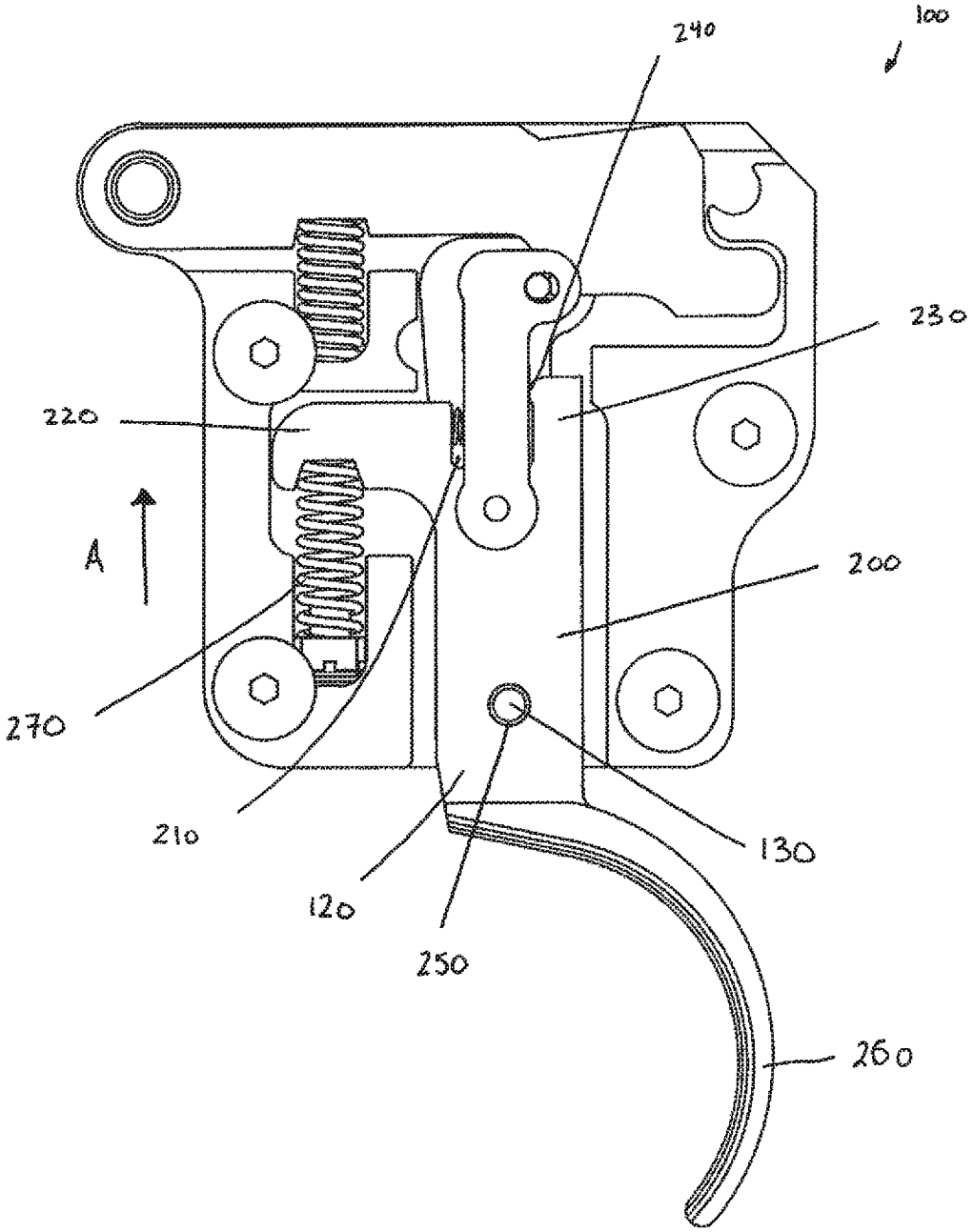
FIG. 2 is a cross-sectional view of the trigger device of FIG. 1 identifying trigger components.

As shown in FIG. 2, the trigger 120 comprises an body 200 having a recess 210, a first arm 220, a second arm 230, an aperture 250, and an arcuate actuation member 260. The first arm 220 and the second arm 230 are positioned at a first end of the body 200. The first arm 220 extends laterally from the body 200. The second arm 230 extends axially from the body 200 and includes a protrusion 240. In the present embodiment, the protrusion 240 is rounded. The recess 210 is defined between the first arm 220 and the second arm 230. The aperture 250 is configured to receive the trigger pivot pin 130. The actuation member 260 extends from the body 200 on an opposite end to the first and second arms 220, 230. In an embodiment, the actuation member 260 is generally C-shaped and is configured to be actuated by a user.

An adjustable trigger biasing member 270 extends from the housing 110 to a bottom portion of the first arm 220. The adjustable trigger biasing member 270 is described in greater detail with reference to FIGS. 19 and 20. The adjustable trigger biasing member 270 is configured to exert an upward force on the first arm 220 of the trigger 120, as indicated arrow A, thereby generating a trigger pull weight felt by a user. In the absence of any external force, the adjustable trigger biasing member 270 causes the trigger body 200 to rotate about the trigger pivot 130 so that the actuation member 260 is maintained in a ready position.

Figure 3:
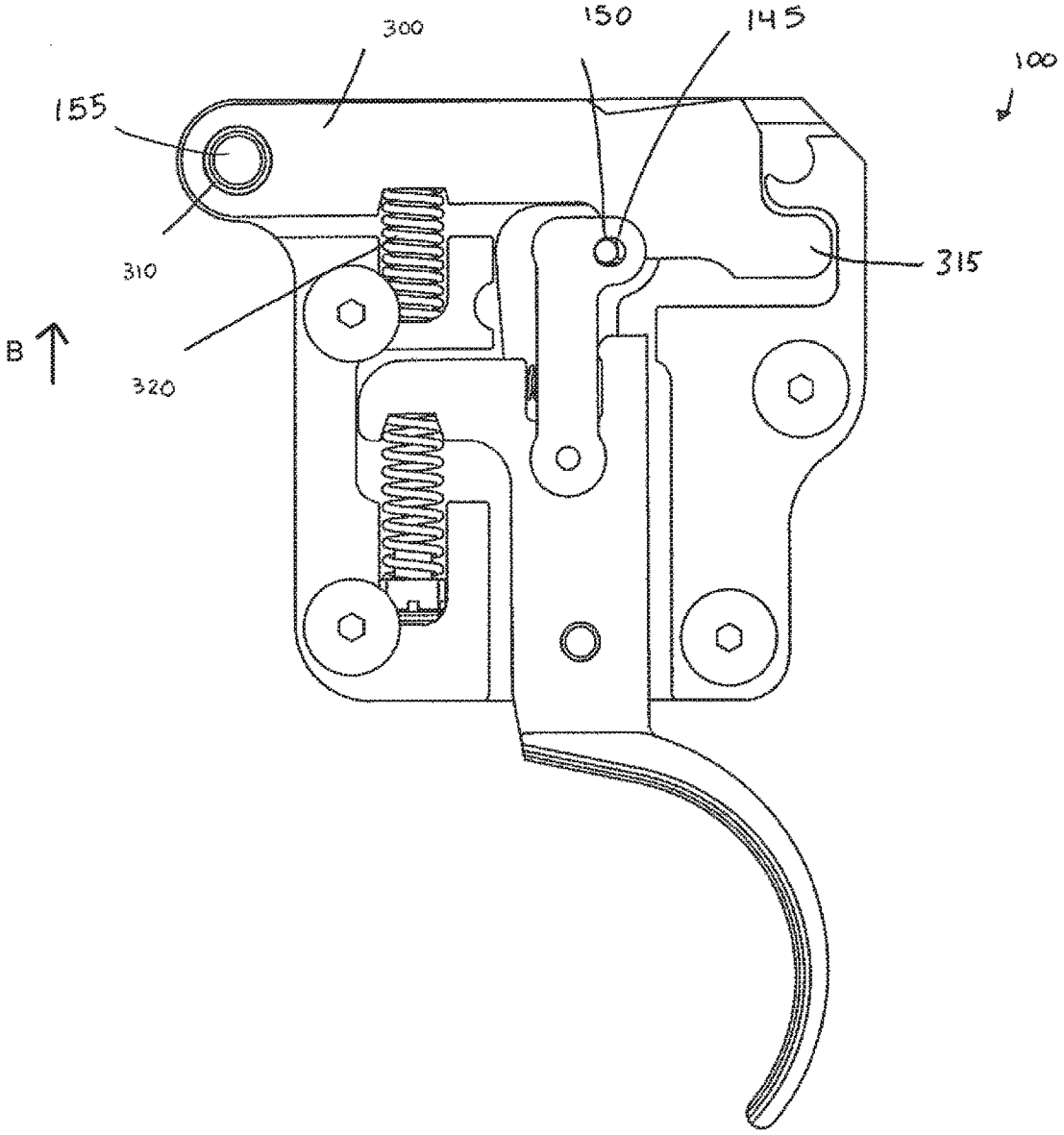
FIG. 3 is a cross-sectional view of the trigger device of FIG. 1 identifying sear arm components.

As shown in FIG. 3, the sear 140 comprises a body 300 having a sear arm aperture 310 and a tail 315. The sear arm aperture 310 is defined adjacent an end of the body 300 distal to the tail 315. The sear arm aperture 310 is configured to receive the sear pivot pin 155. The first sear surface 145 and second sear surface 150 are defined proximal the tail 315 of the body 300.

A sear biasing member 320, extends from the housing 110 to a bottom portion of the body 300 proximal the aperture 310. In an embodiment, the sear biasing member 320 is a spring. The sear biasing member 320 is configure to exert an upward force on the body 300 of the sear 140, as indicated by arrow B. The sear biasing member 320 causes the sear body 300 to oppose a downward force exerted by a firing pin (not shown) on the tail 315, thereby biasing the sear body 300 in a starting position.

Figure 4:
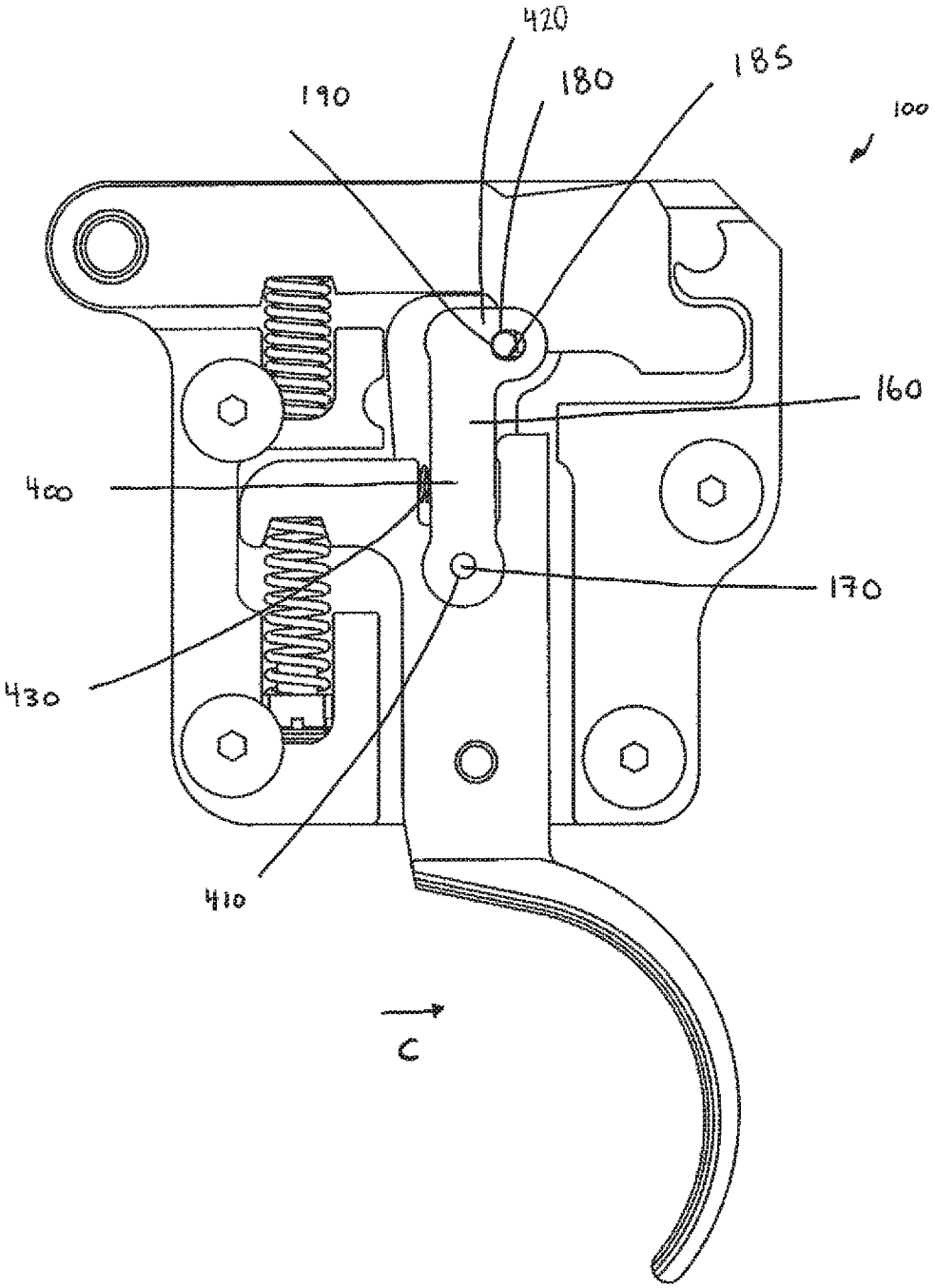
FIG. 4 is a cross-sectional view of the trigger device of FIG. 1 identifying ticker components.

As shown in FIG. 4, the ticker 160 comprises a ticker body 400 having a ticker aperture 410 proximal one end of the ticker body 400. The other end of the ticker body 400 comprises a pair of spaced apart flanges 420 that together define a slot to receive a portion of the sear 140 including the first sear surface 145 and the second sear surface 150. The ticker aperture 410 is configured to receive the ticker pivot pin 170. The spaced apart flanges 420 extend laterally from the ticker body 400 each comprise apertures that together define the roller aperture 180.

As mentioned previously, the ticker 160 is pivotally attached to the trigger 120 about the ticker pivot pin 170.

The ticker 160 is positioned such that a portion of the ticker body 400 is partially retained in the recess 210 of the trigger 120. A ticker biasing member 430 extends from the recess 210 of the trigger 120 to the ticker body 400. The ticker biasing member 430 is configured to exert a force on the ticker 160 in a direction as indicated by arrow C, that is substantially perpendicular to the force exerted by the trigger biasing member 270. In addition, the ticker biasing member 430 acts in concert with the trigger biasing member 270 to bias the trigger body 200.

Figure 5:
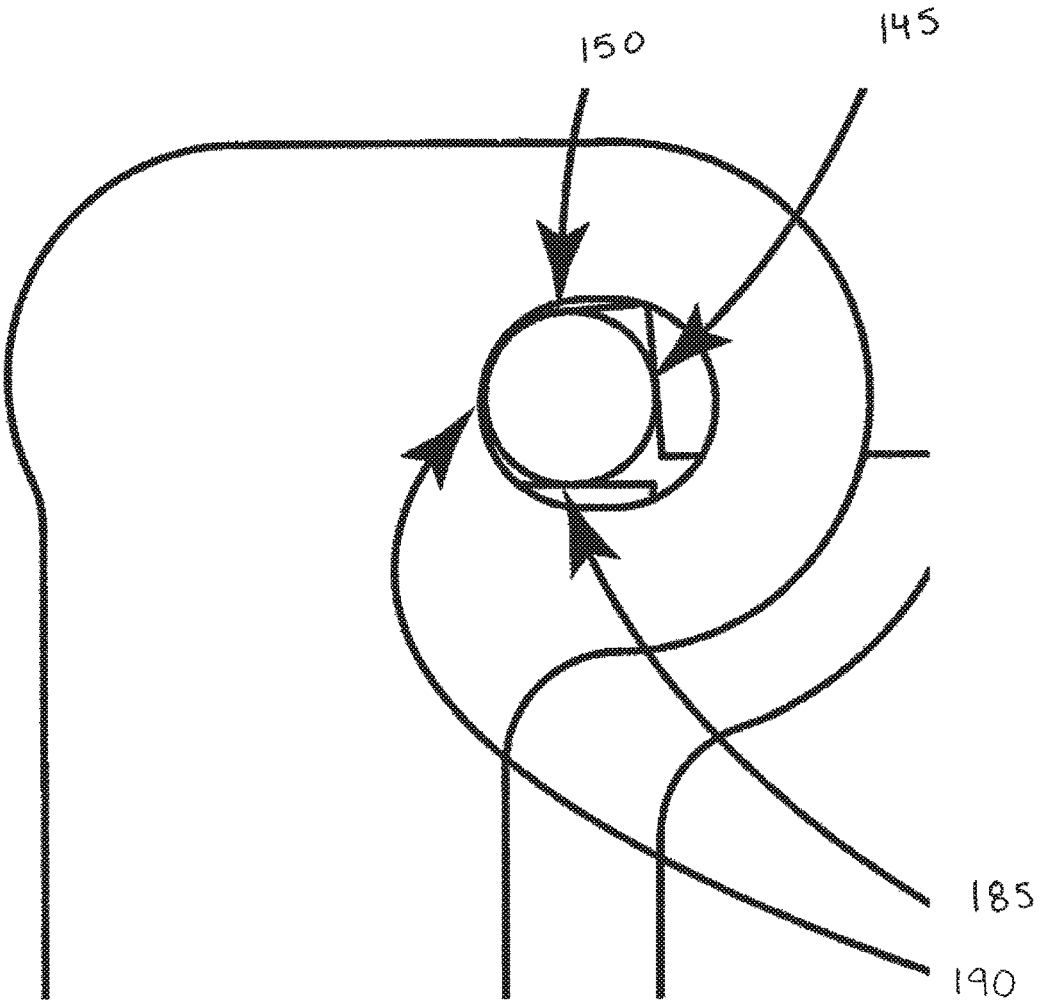
FIG. 5 is a magnified view of the trigger device of FIG. 1 identifying captured roller components.

The roller 195 is rotatably coupled to the ticker 160 through the ticker aperture 180 and extends through the slot defined by the spaced apart flanges 420. In an embodiment, the captured roller 195 cylindrical. The roller 195 is coupled to the ticker 160 for rotation about its central axis. Further, the roller 195 can move laterally within the ticker aperture 180. The roller 195 extends through the aperture 180 of the ticker such that it is positioned between the first and second sear surfaces 145, 150 of the sear 140 and the first and second contact surfaces 185, 190 of the ticker 160, as shown in FIG. 5. Relative movement between the ticker 160 and the sear 140 causes the captured roller 195 to rotate and/or translate thereby reducing sliding friction.

The trigger 120 is pivotable about the trigger pivot pin 130 between a ready position and a fire position. In the ready position, the trigger 120 is positioned such that the first arm 220 is not in contact with the housing 110, and the protrusion 240 of second arm 230 is in contact with the ticker 160. In the fire position, the trigger 120 is positioned such that the first arm 220 is in contact with the housing 110, and the protrusion 240 of the second arm 230 is not in contact with the ticker 160.

The sear 140 is pivotable about the sear pivot pin 155 between a captured position and a released position. In the captured position, the sear 140 is held in place by the engagement of the first and second sear surfaces 145, 150 with the captured roller 195. In the released position, the first and second sear surfaces 145, 150 are disengaged from the captured roller 195 and the tail 315 is in contact with the housing 110.

The ticker 160 is pivotable about the ticker pivot pin 170 between a first position and a second position. In the first position, the roller 195 is held between the first and second contact surfaces 185, 190 and the ticker 160 is in contact with the protrusion 240 of the second arm 230 of the trigger 120. In the second position, the ticker 160 is not in contact with the protrusion 240 of the second arm 230 of the trigger 120.

Figure 6:
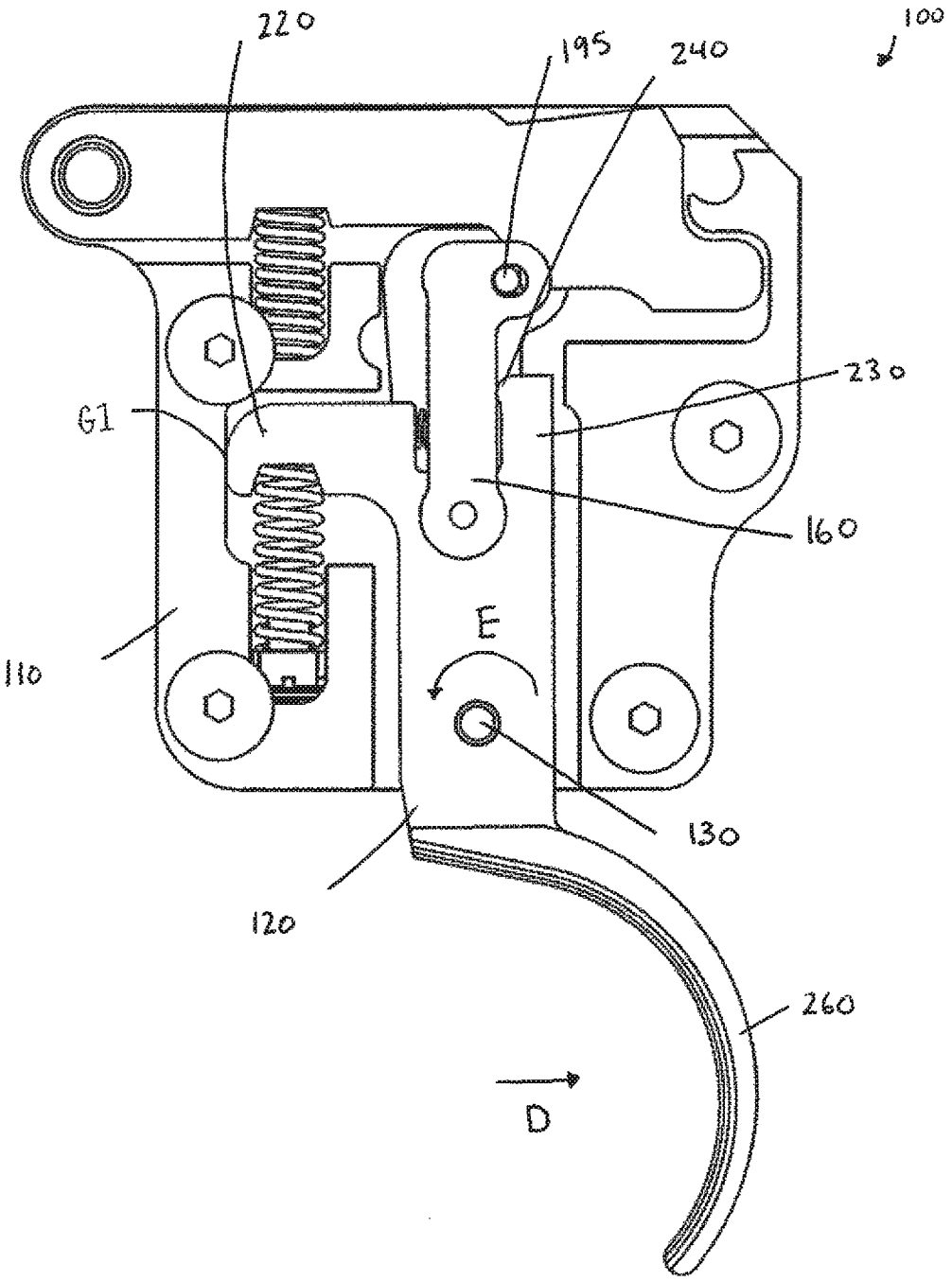
FIGS. 6 to 15 are cross-sectional views of the trigger device of FIG. 1 showing various positions during operation.

During operation, a user actuates the trigger device 100 by applying a force on the actuation member 260 in a direction indicated by arrow D, as shown in FIG. 6. The trigger 120 begins to pivot out of the ready position towards the fire position. Specifically, the trigger 120 rotates about the trigger pivot pin 130 in a direction indicated by arrow E. In the position shown in FIG. 6, a small gap G1 exists between the first arm 220 of the trigger 120 and the housing 110. The protrusion 240 of the second arm 230 of the trigger 120 is in contact with the ticker 160. As such, the ticker 160 follows movement of the trigger 120.

Figure 7:
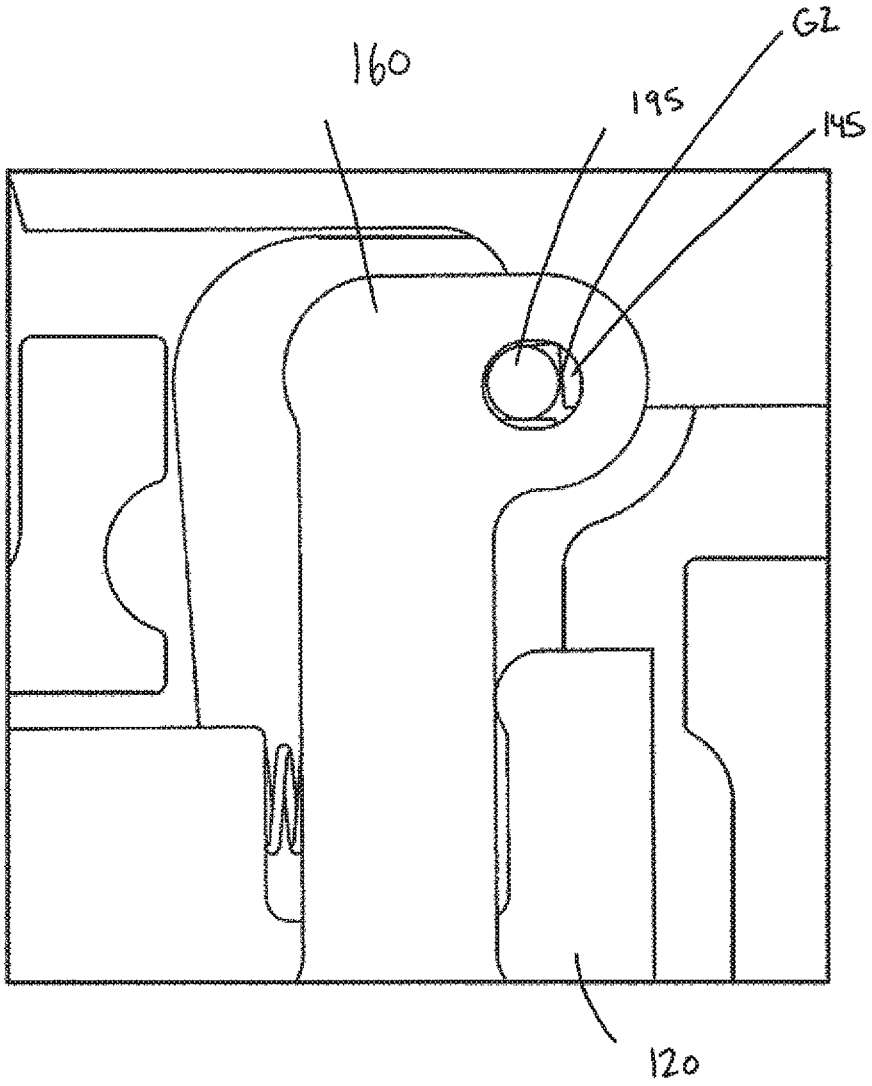

As shown in FIG. 7, the movement of the ticker 160 produces a gap between the second sear surface 190 of the ticker aperture 180 and the roller 195. The gap allows the roller 195 to translate in a direction away from the first sear surface 145 under force from the second surface 150, creating a gap G2 between the roller 195 and the first sear surface 145.

Figure 8:
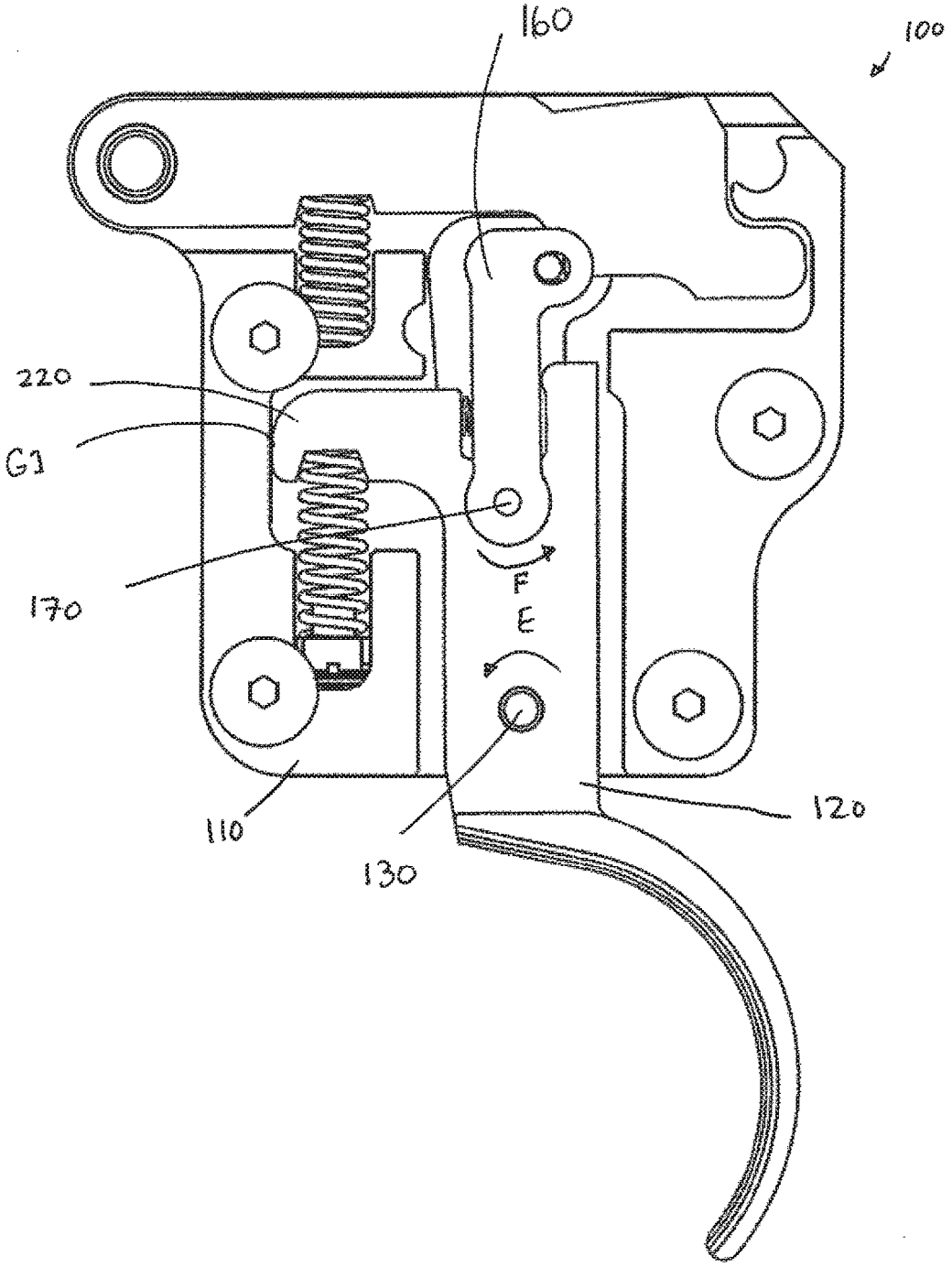

As shown in FIG. 8, further rotation of the trigger 120 about the trigger pin 130 in the direction indicated by arrow E reduces the gap G1 between the first arm 220 of the trigger 120 and the housing 110. The ticker 160 begins to pivot out of the first position towards the second position. Specifically, the ticker 160 rotates about the ticker pivot pin 170 in a direction indicated by arrow F.

Figure 9:
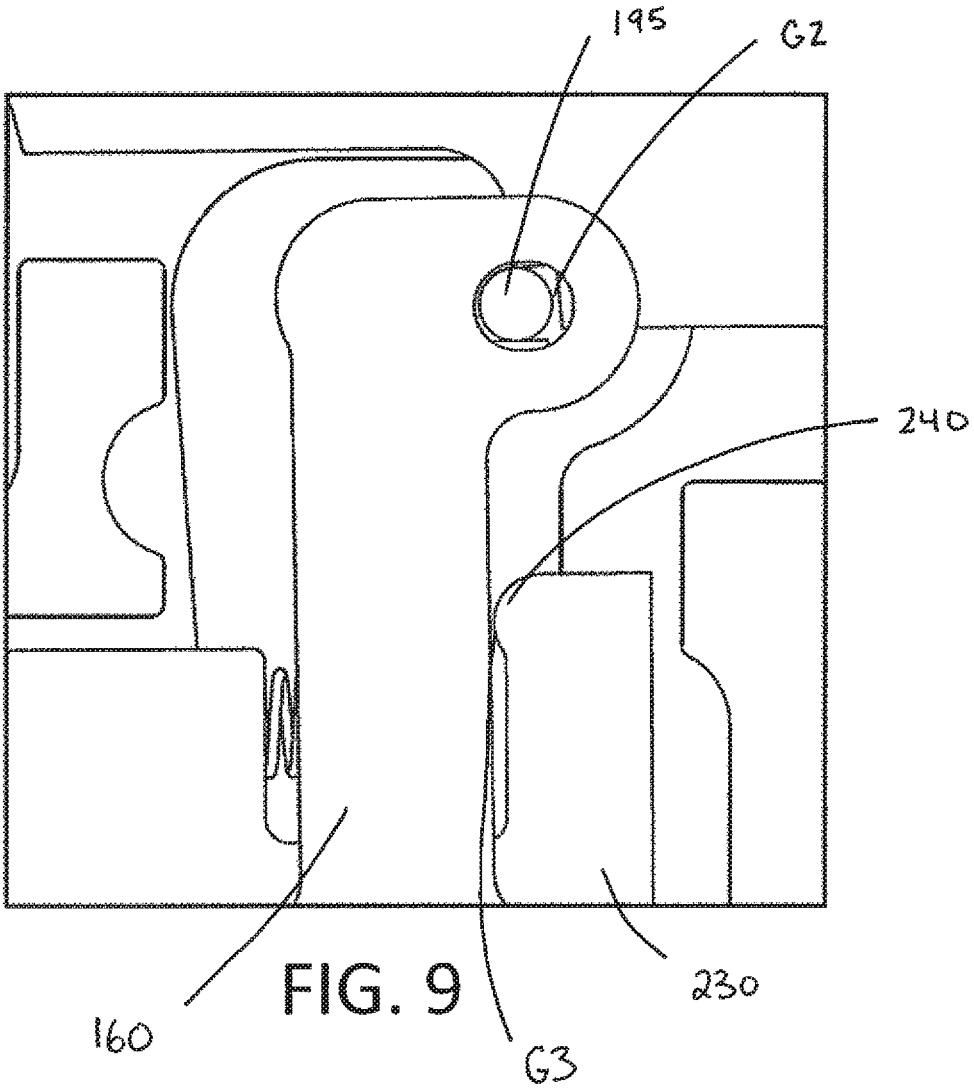

As shown in FIG. 9, the ticker 160 has rotated substantially off its axis, at which point the force from the second surface 150 overcomes the force from the ticker biasing member 430 resulting in further rotation of the ticker 160 in the direction indicated by arrow E. This further rotation creates a gap G3 between the ticker 160 and the protrusion 240 of the second arm 230 of the trigger 120 and increases the size of the gap G2.

Figure 10:
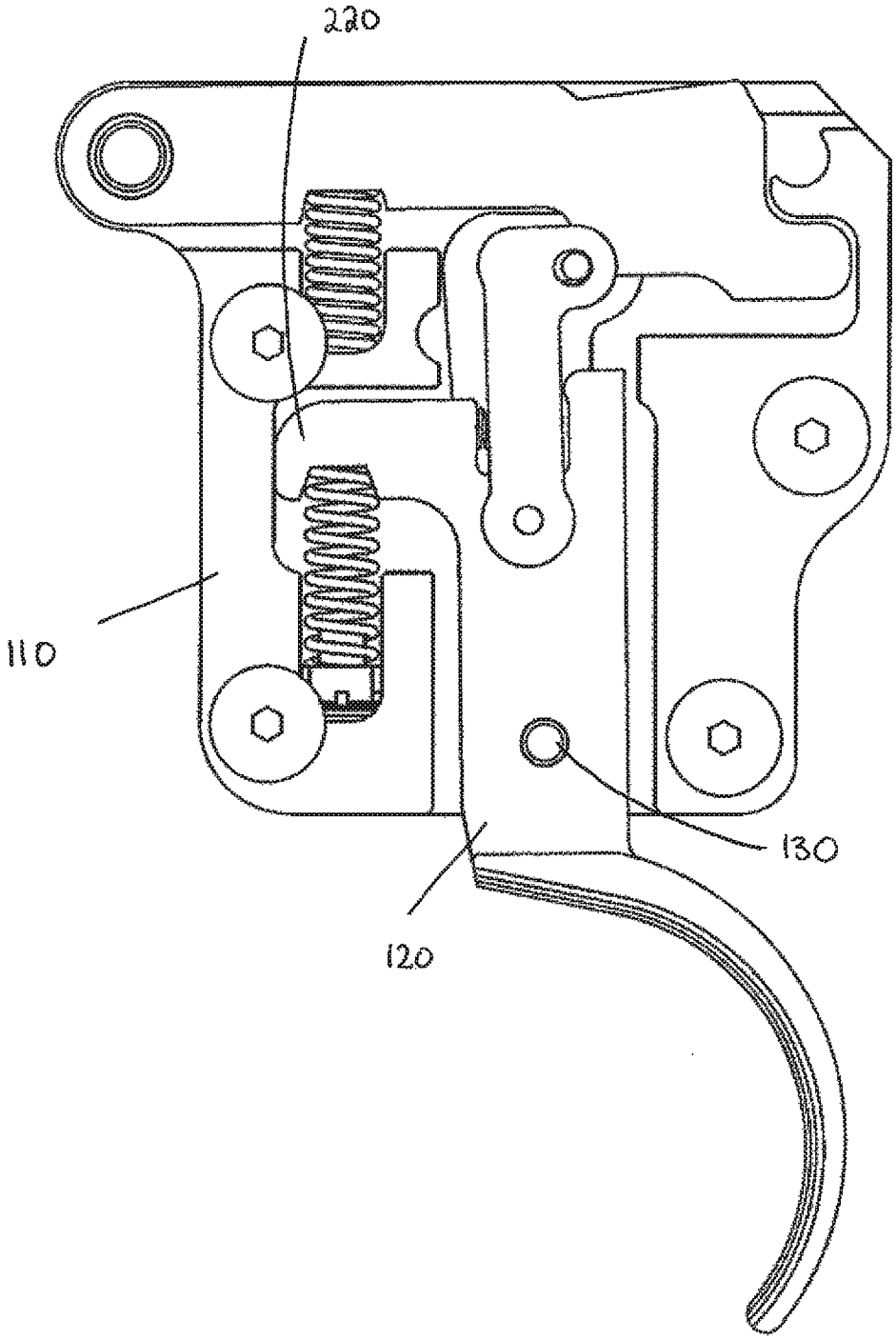
Figure 11:
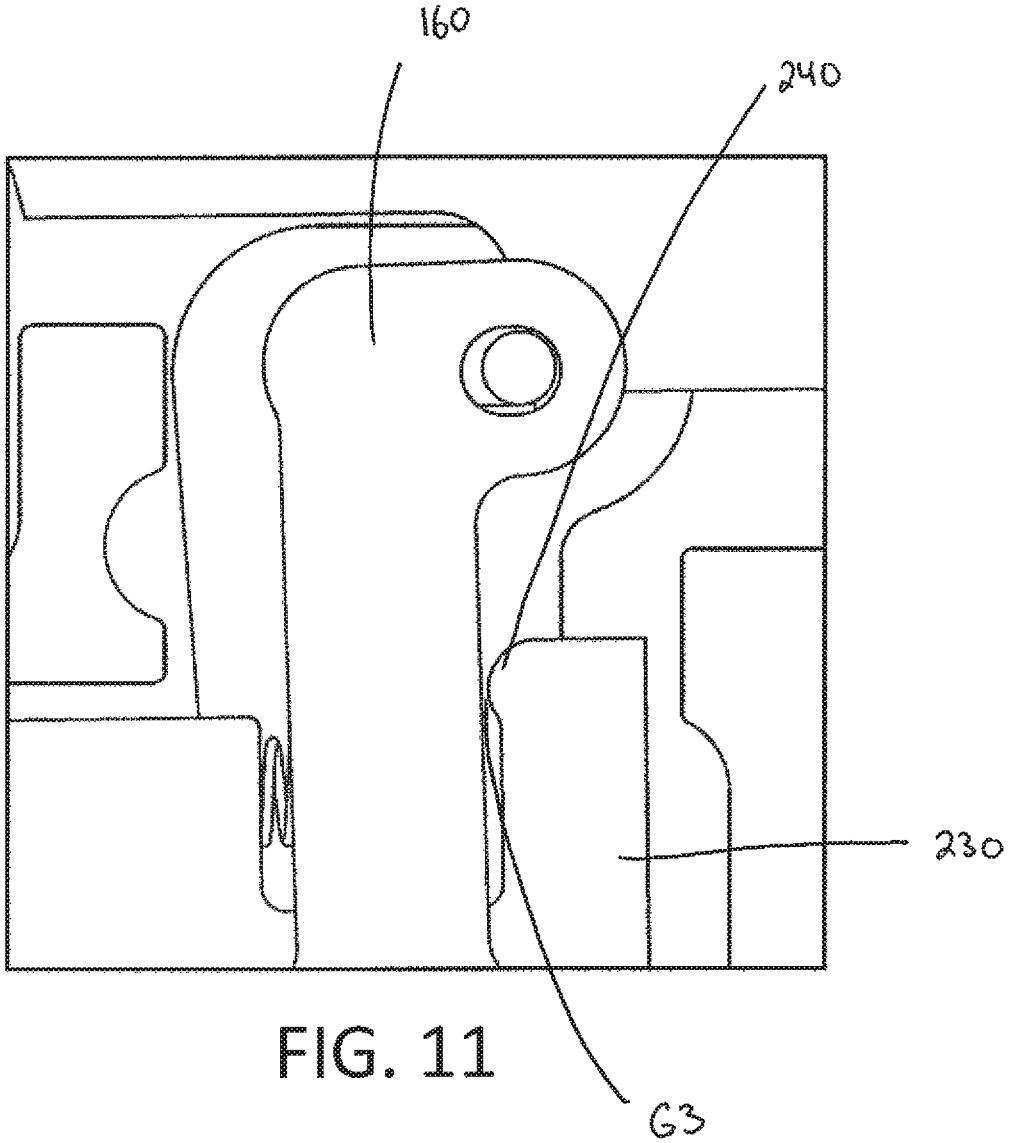

As shown in FIG. 10, rotation of the trigger 120 about the trigger pivot pin 130 ends when the trigger 120 has reached the fire position. In the fire position, the first arm 220 of the trigger 120 contacts the housing 110. The ticker 160 continues to rotate in the direction indicated by arrow E thereby increasing the size of the gap G3 between the ticker 160 and the protrusion 240 of the second arm 230 of the trigger 120, as shown in FIG. 11.

Figure 12:
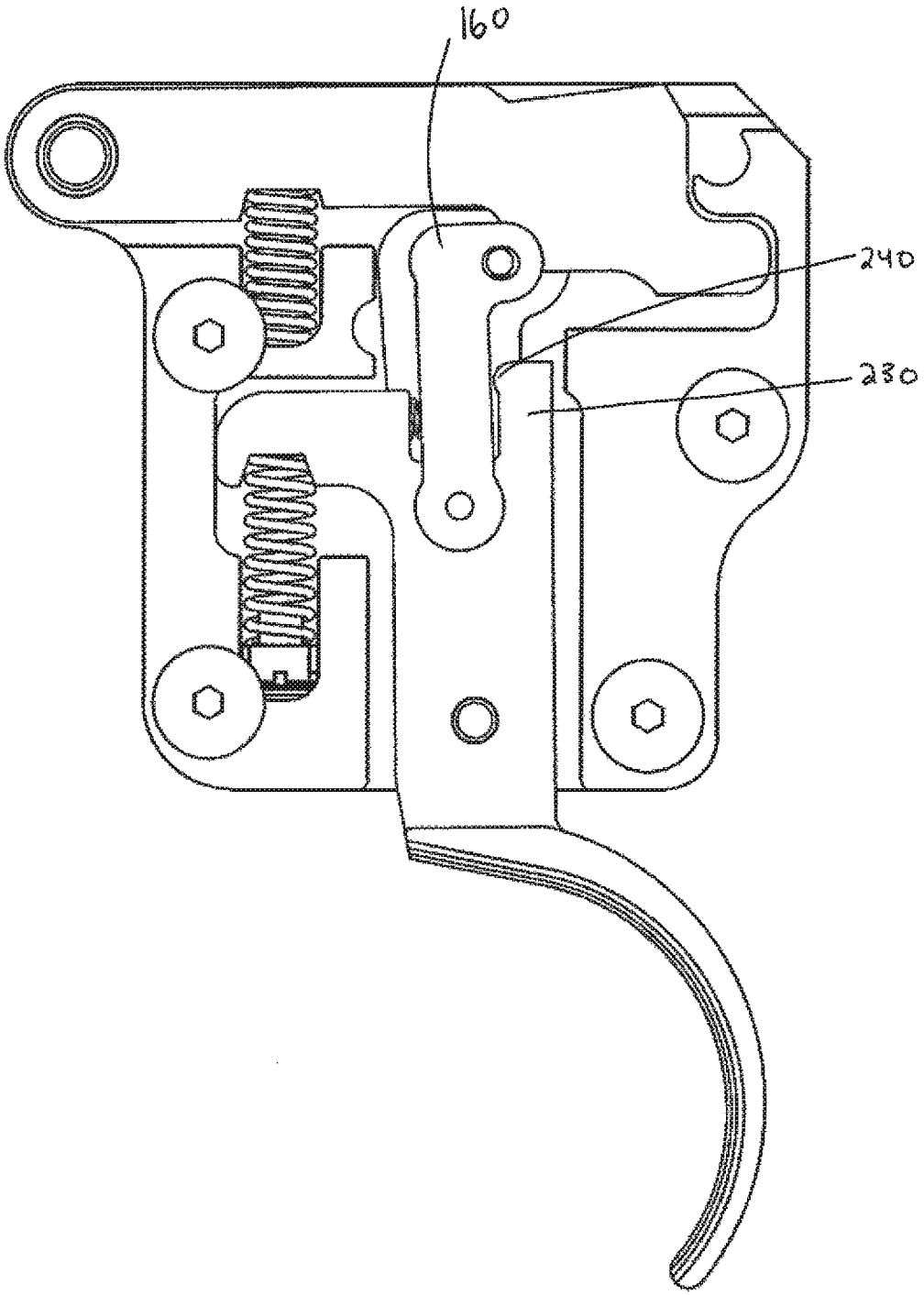
Figure 13:
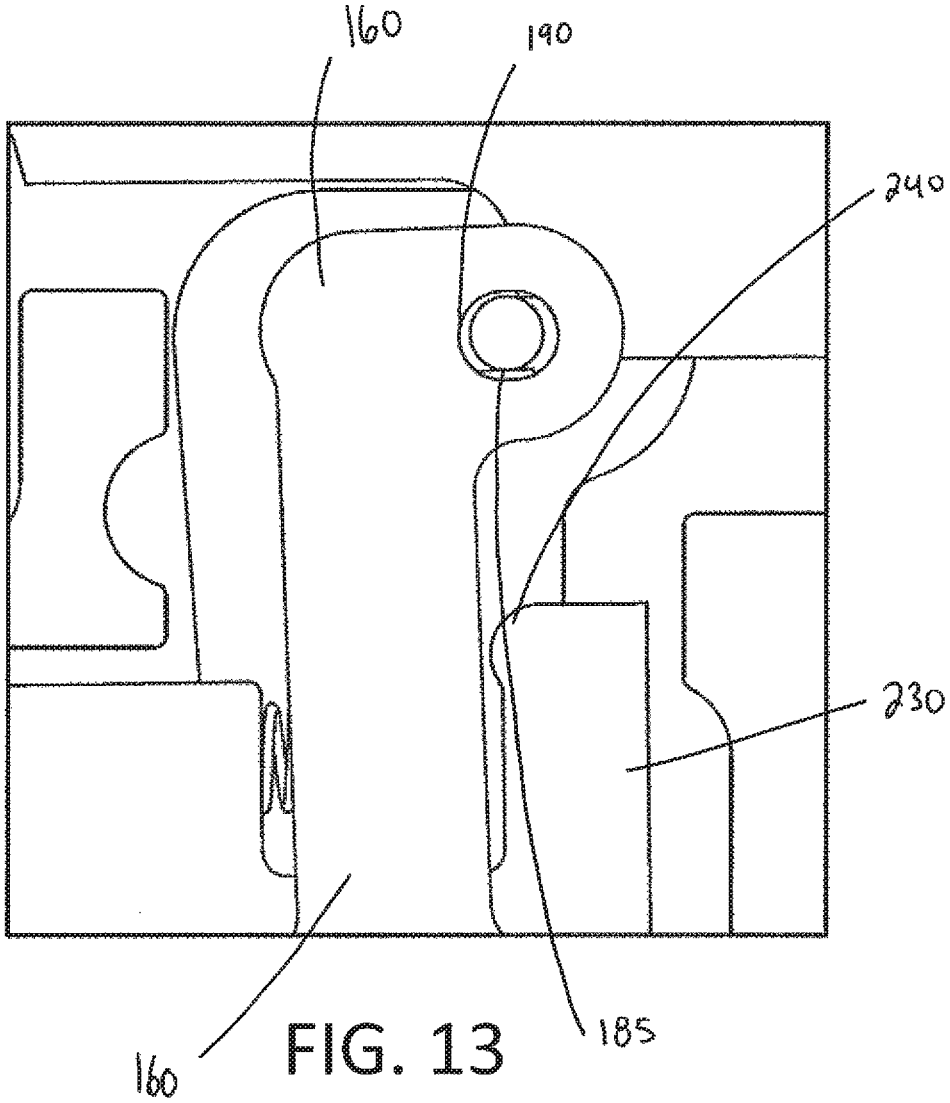
Figure 14:
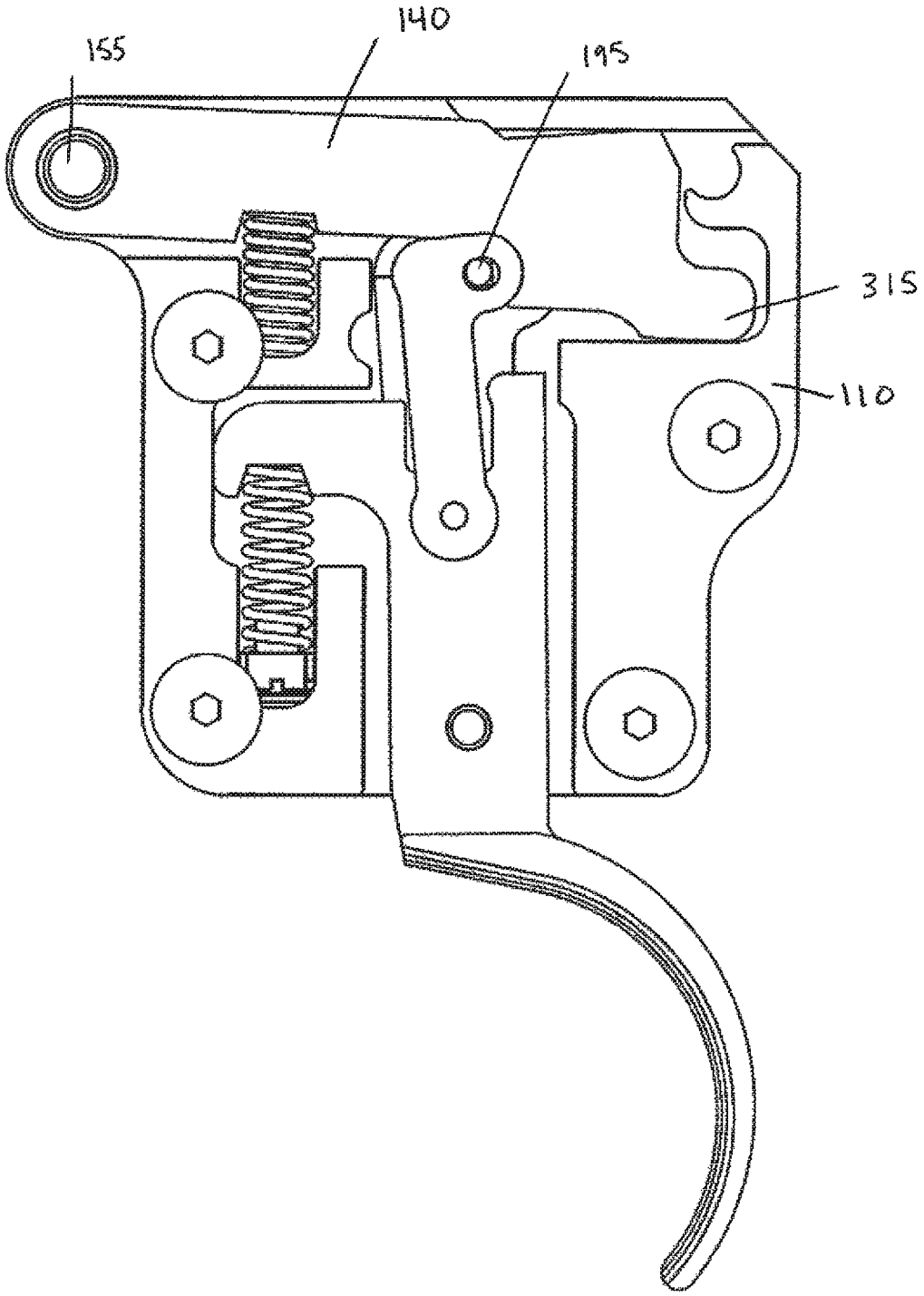
Figure 15:
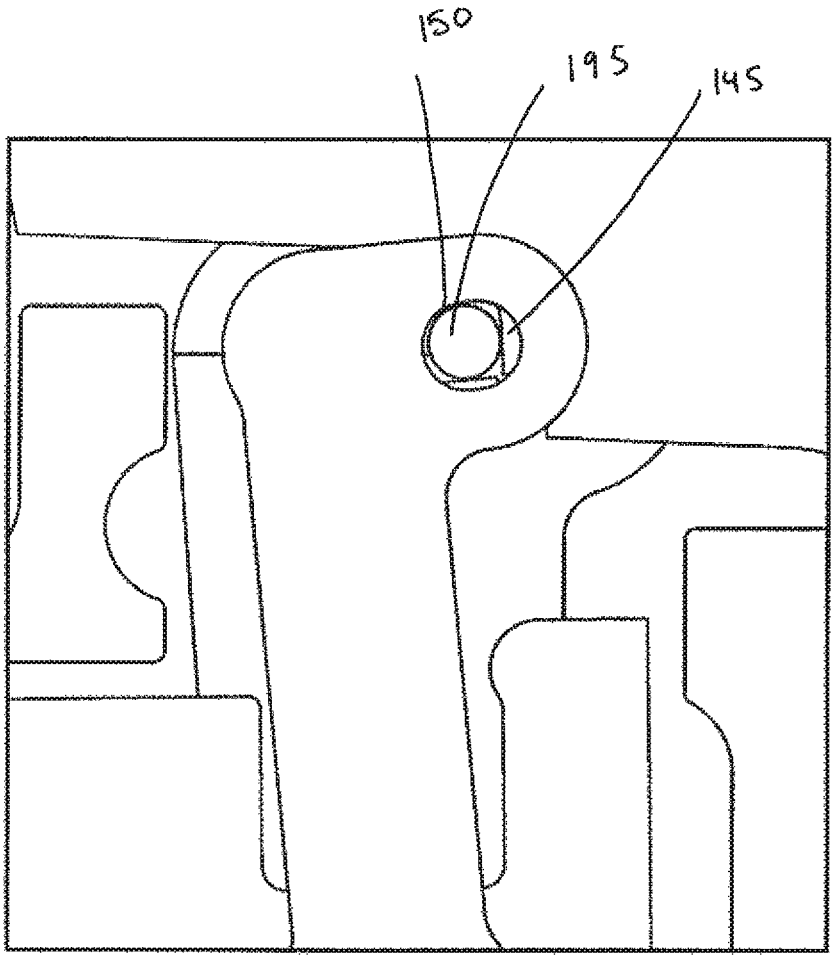

As shown in FIGS. 12 and 13, rotation of the ticker 160 about the ticker pivot pin 170 continues. As shown in FIGS. 14 and 15, the ticker 160 has reached the second position, and the roller 195 is disengaged from the first and second sear surfaces 145, 150. As a result, the sear 140 has rotated about the sear pivot pin 155 from the captured position to the released position. The sear 140 rotates or drops until the tail 315 contacts the housing 110. As a result, the firing mechanism of the firing device is released thereby causing the firing device to fire.

As will be appreciated, trigger device described above reduces the trigger pull load as compared to the trigger pull load required for conventional trigger assemblies. Specifically, conventional triggers need to have a certain amount of movement to disengage the overlapping surfaces between the sear and trigger structures, often referred to as trigger creep. In a conventional trigger, the trigger creep can be anywhere from 5 mm to 0.2 mm. In accordance with the trigger described herein, the trigger creep is reduced below 0.2 mm and may be minimized to almost nothing. The reduction in trigger creep is achieved, at least in part, because the trigger 120 relies primarily on a balance of forces to release the trigger and actuate the firing mechanism, rather than displacement, as will be described below.

Figure 18:
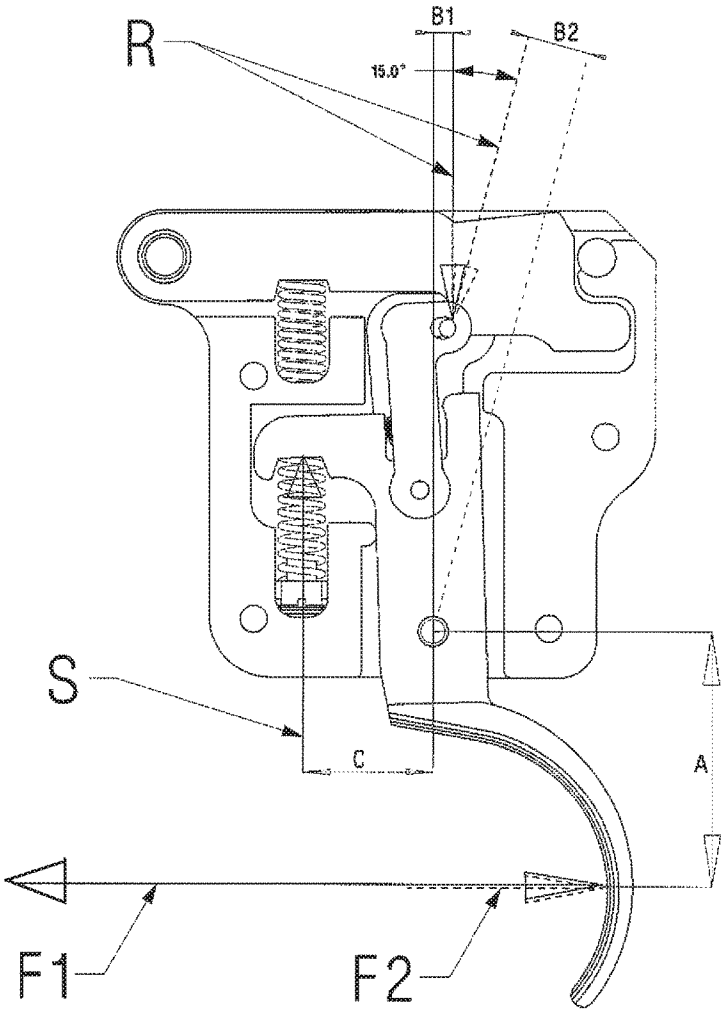
FIG. 18 is a cross-sectional view of the trigger device showing the forces acting within the trigger device.

Referring to FIG. 18, a force diagram illustrating principal forces in the trigger 120 is shown. The principal forces include a sear force R, a preload spring force S, a pre-release trigger force F1 and a trigger release force F2. The sear force R represents the force applied by the sear body 140 on the roller 195. The preload spring force S represents the force applied by the springs to maintain the trigger in the ready position and provide the trigger pull weight.

A trigger force offset A represents a vertical offset between the trigger forces F1 and F2 and the trigger pivot pin 130. A spring force offset C represents a horizontal offset between the trigger pivot pin 130 and the preload spring force S. A sear force offset B represents a horizontal offset between the sear force R and the trigger pivot pin 130.

When the trigger is 120 is ready to fire, prior to the application of the trigger force F1, the sear force R is positioned substantially vertically and directed behind the trigger pivot pin 130 as indicated at position R1. Thus, in this position, the sear force R retards rotation of the trigger 120 about the trigger pivot pin 130. As the trigger 120 is released and the trigger force is applied, the sear force R translates from position R1 to position R2, at which point the sear force R is directed in front of the trigger pivot pin 130. Thus, in this position, the sear force R advances rotation of the trigger 120 about the trigger pivot pin 130.

Accordingly, a high level representation of the forces about the trigger pivot pin 130 prior to release of the trigger 120 is:

$$S \times C + R \times B1 - F1 \times A = 0$$

$$\therefore F1 = \frac{S \times C + R \times B1}{A}$$

A high level representation of the forces about the trigger pivot pin 130 after release of the trigger 120 is:

$$\curvearrowright Tp + S \times C - R \times B2 - F2 \times A = 0$$

$$\therefore F2 = \frac{S \times C - R \times B2}{A}$$

The trigger 120 will release when the user applies a force equal or greater than the pre-release trigger force F1. During the release of the trigger 120 the pre-release trigger force F1 will change direction to the trigger release force F2 resulting in the user experiencing a sensation of a very crisp and sudden break during the trigger release. The characteristic of the trigger release can be tuned by varying sear force offset B and/or an offset of the ticker pivot pin 170 in relation to the trigger pivot pin 130.

Figure 16:
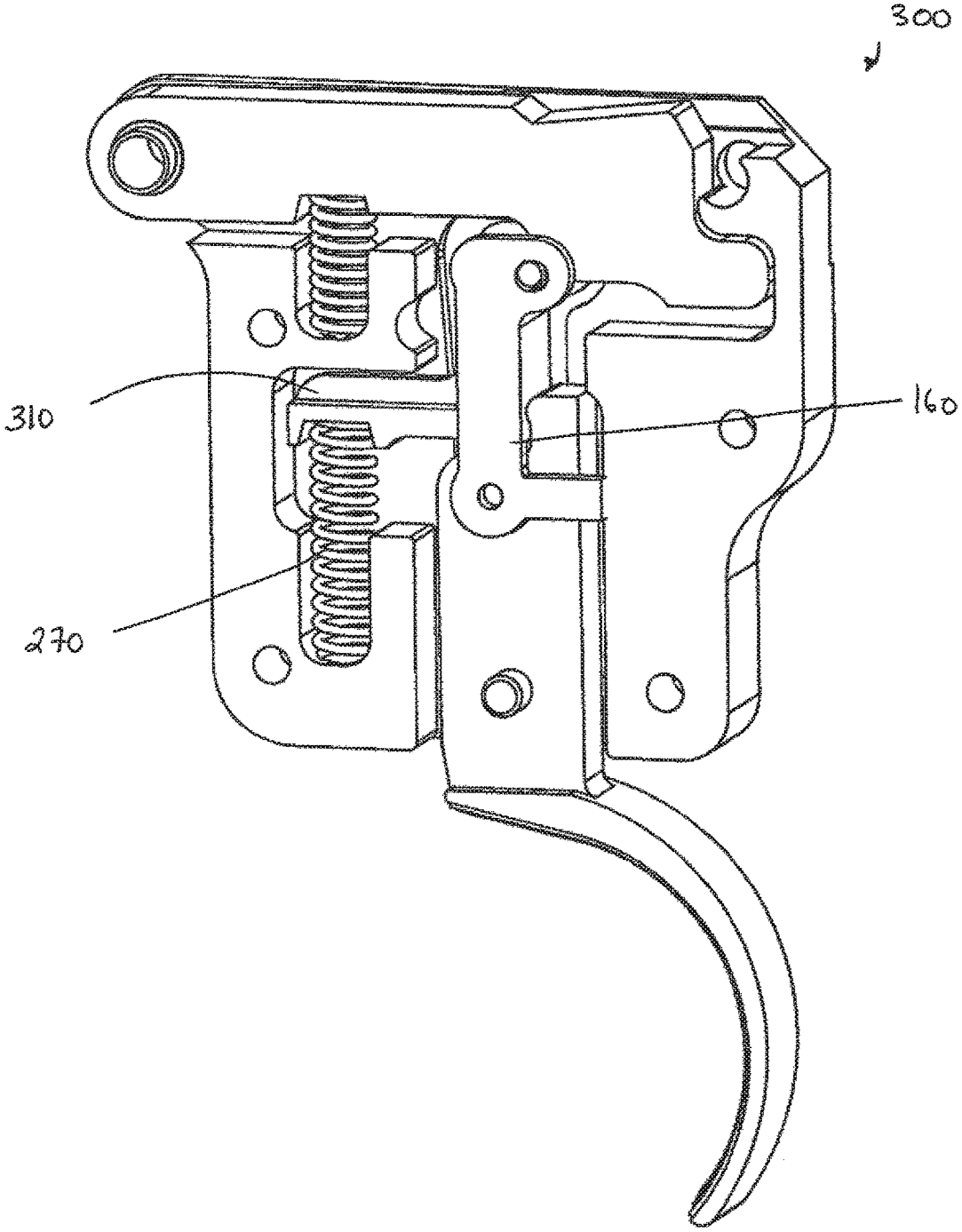
FIG. 16 is an isometric view of another embodiment of a trigger device.

Another embodiment of a trigger device 300 is shown in FIG. 16. Trigger device 300 is generally similar to that of trigger device 100 with the following exceptions. In this embodiment, the trigger 120 does not comprise a first arm and a ticker biasing member is not required. Rather, the ticker 160 comprises an arm 310 extending therefrom. The arm 310 is attached at a first end to the adjustable trigger biasing member 270. The operation of trigger device 300 is generally similar to that of trigger device 100 and as such the specifics will not be described.

Figure 17:
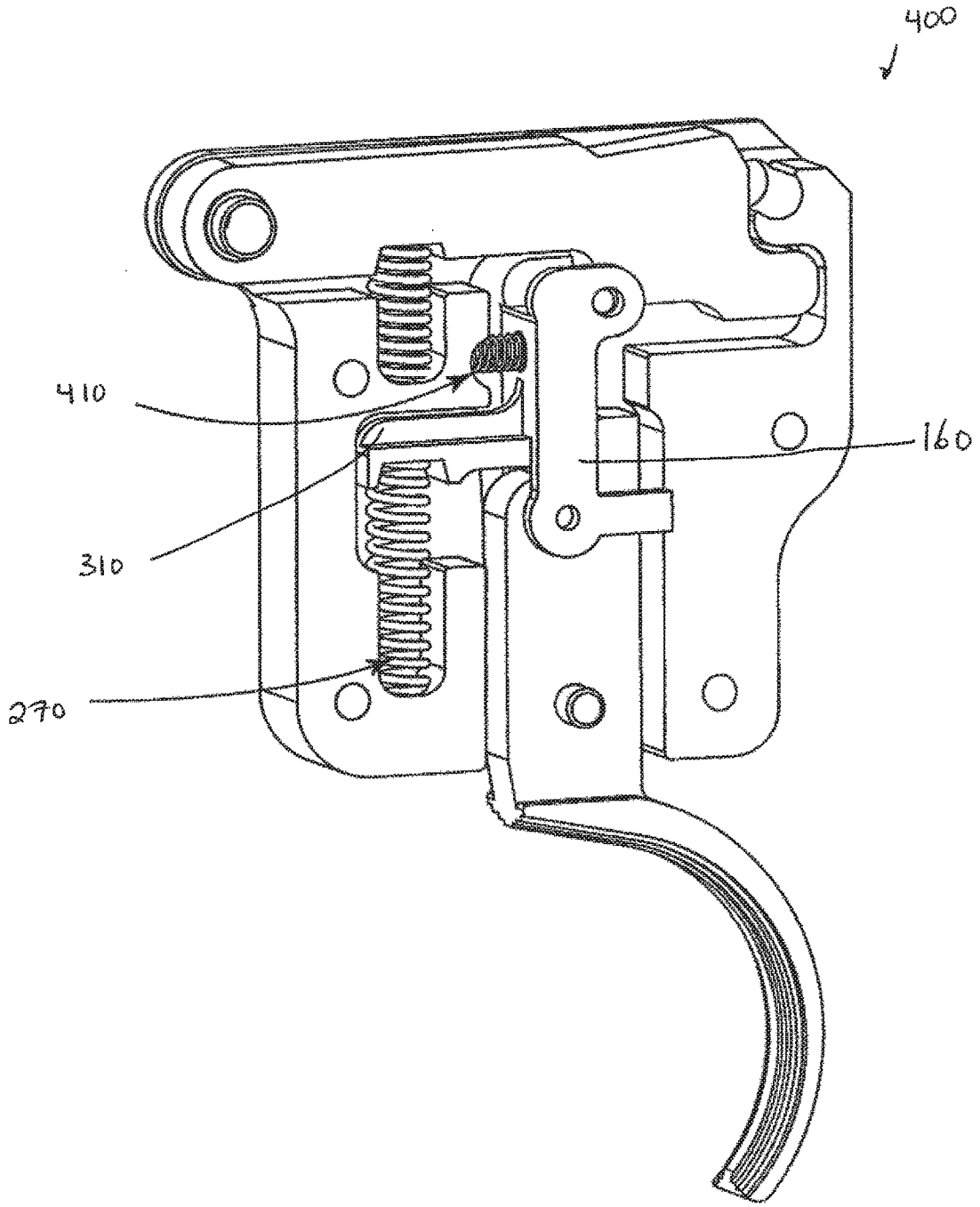
FIG. 17 is an isometric view of another embodiment of a trigger device.

Another embodiment of a trigger device 400 is shown in FIG. 17. Trigger device 400 is generally similar to that of trigger device 300 with the following exceptions. In this embodiment, the trigger device 400 comprises a ticker biasing member 410 coupled to the arm 310 extending from the ticker 160. The ticker biasing member 410 may be adjusted to add higher pre-load on the ticker, while still permitting fine adjustment control on the trigger biasing member 270. The operation of trigger device 400 is generally similar to that of trigger device 300 and as such the specifics will not be described.

Figure 19:
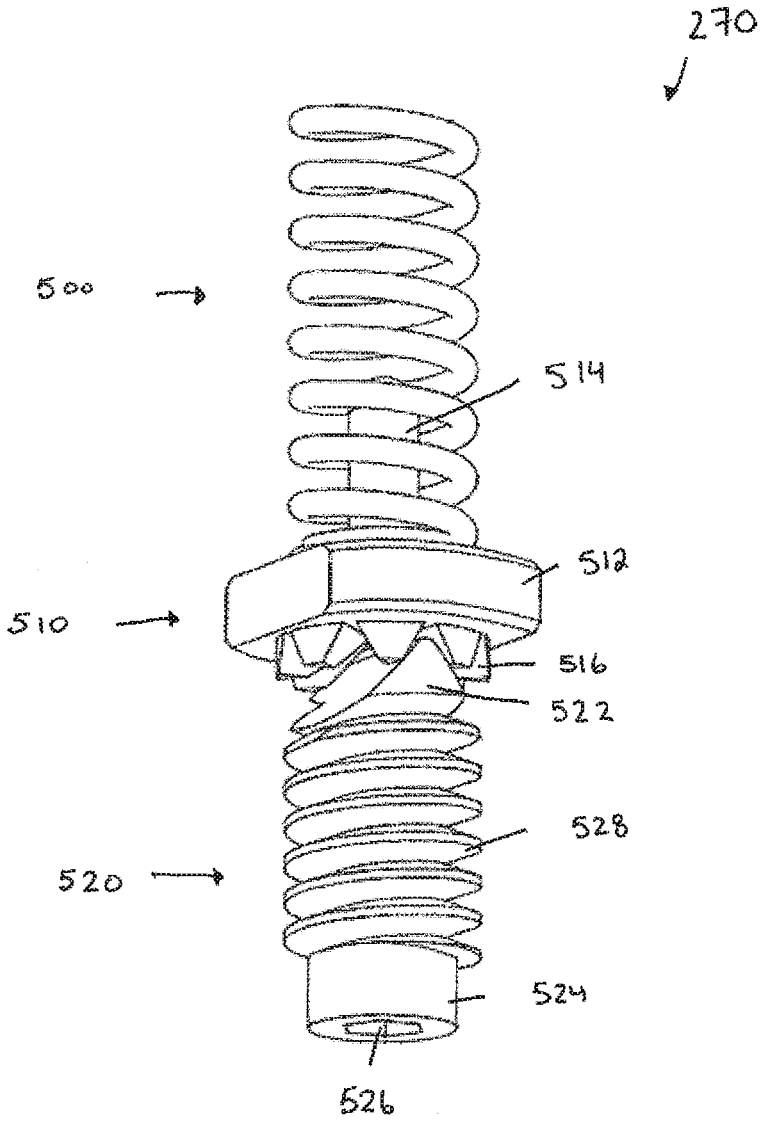
FIG. 19 is a front plan view of an adjustable trigger biasing member forming part of the trigger device of FIG. 1.
Figure 20:
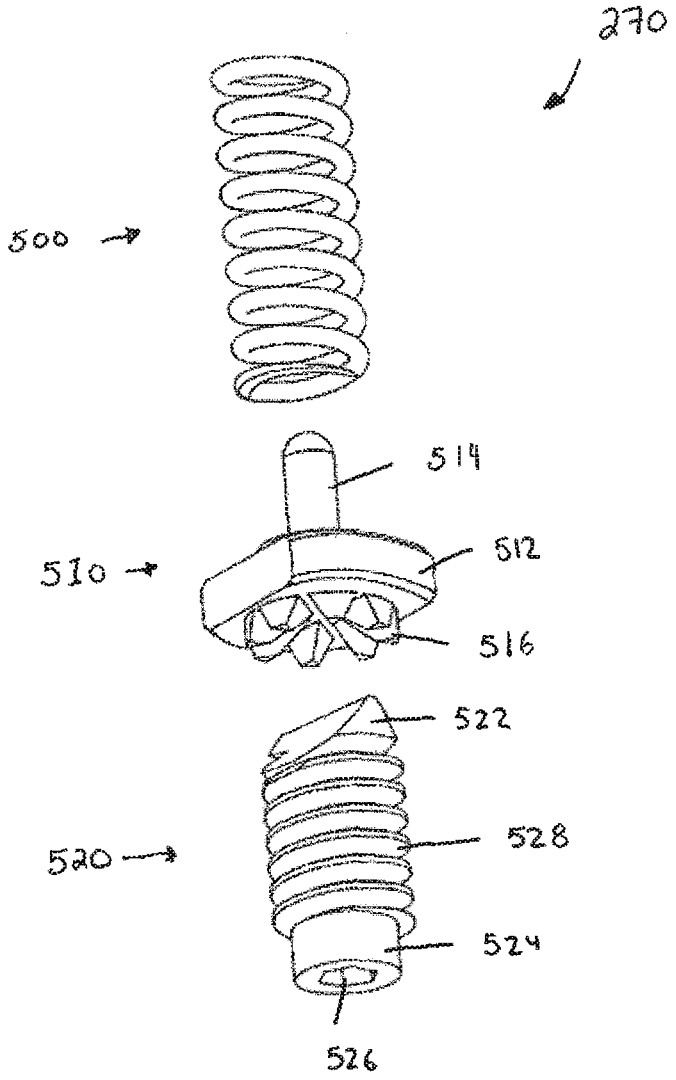
FIG. 20 is an exploded view of the adjustable trigger biasing member of FIG. 19.

As previously mentioned, the adjustable trigger biasing member 270 is shown in FIGS. 19 and 20. As can be seen, the adjustable trigger biasing member 270 comprises a spring 500, a feedback member 510, and a threaded wedge screw 520.

The spring 500 is connected at a first end to the trigger arm (not shown) and at a second end to the feedback member 510.

The feedback member 510 comprises a body 512. The body 512 is configured to receive the second end of the spring 500. A protrusion 514 extends from a surface of the body 512 such that the protrusion 514 is generally encapsulated by a portion of the spring 500. A number of wedge shaped projections 516, in this embodiment eight (8), extend from an opposite surface of the body 512 to that of the protrusion 514. The wedge shaped projections 516 are equally spaced about the surface of the body 512.

A first end 522 of the threaded wedge screw 520 is generally wedge shaped. The first end 522 is shaped to be received in between neighboring wedge shaped projections 516 on the feedback member 510. A second end 524 of the threaded wedge screw 520 comprises a socket 526 configured to receive a tool. In this embodiment the socket is a hexagonal socket and the tool is an Allen key or a hex key. A threaded body 528 extends between the first end 522 and the second end 524. The threaded body 528 is configured to mate with a threaded connection on the housing of the trigger device (not shown) such that rotation of the threaded wedge screw 520 causes the threaded wedge screw 520 to move vertically with respect to the housing.

The adjustable trigger biasing member 270 is adjustable by inserting a tool (not shown) into the socket 526 and rotating the tool. Rotation of the tool causes the threaded wedge screw 520 to move vertically with respect to the housing. The first end 522 of the threaded wedge screw 520 glides along the surface of one of the wedge shaped projections 516 until it falls back into a position between neighboring wedge shaped projections 516, thereby making a "click" sound. The sound provides feedback to the user indicating that the adjustable trigger biasing member 270 has moved to a new position. As the threaded wedge screw 520 rotates with respect to the housing, the spring is either compressed or decompressed, based on the direction of rotation of the threaded wedge screw 520. As such, the amount of force the adjustable trigger biasing member exerts on the first arm of the trigger exerts is adjusted.

Although in embodiments described above the ticker is described as being coupled to the trigger, those skilled in the art will appreciate that alternatives are available. For example, in another embodiment the ticker may be coupled to the housing. In this embodiment, the trigger may move independently of the ticker until the rounded arm contacts the ticker.

Figure 25:
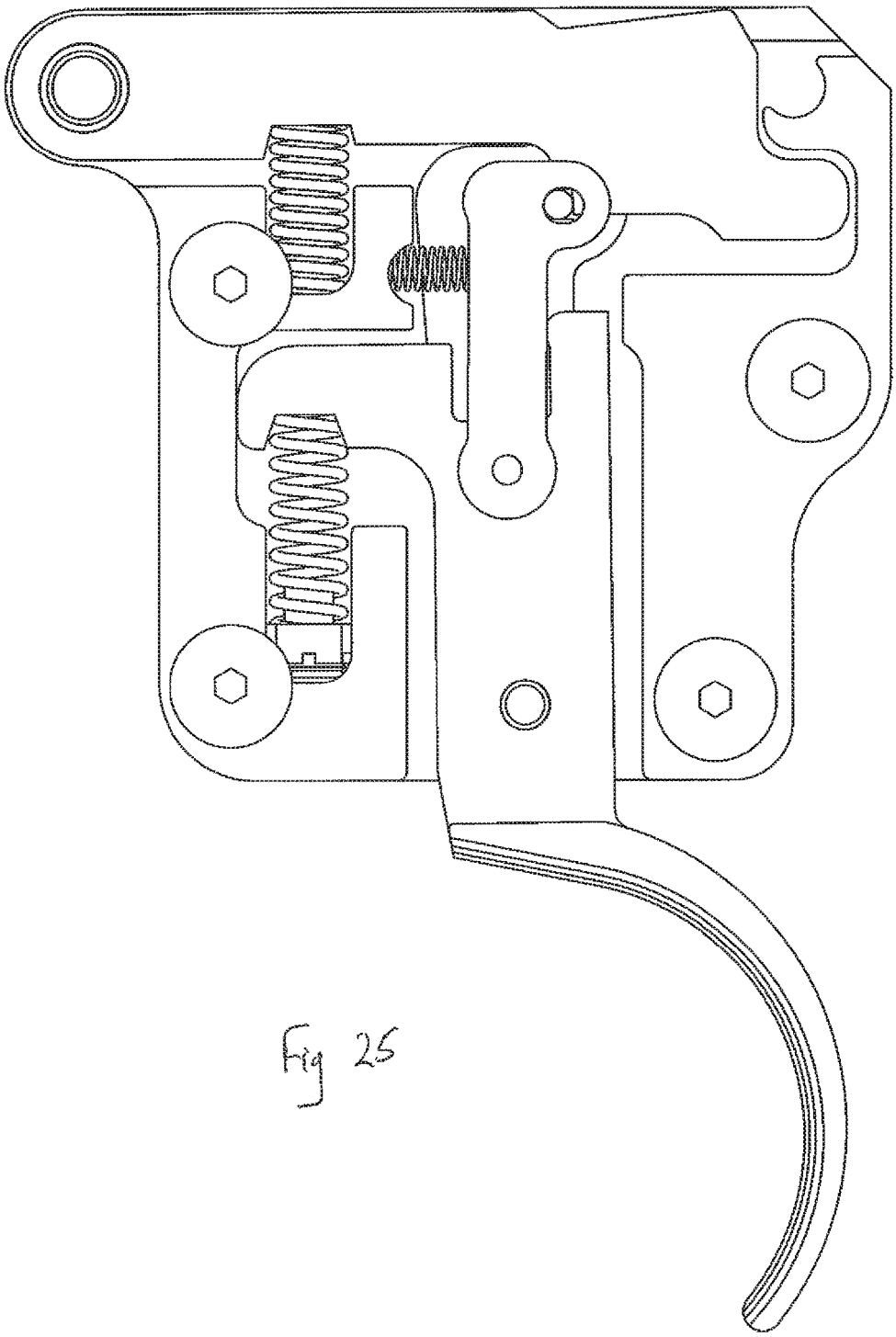
FIGS. 25 and 26 are cross-sectional views of the trigger device of FIG. 1 showing alternate spring configurations.
Figure 26:
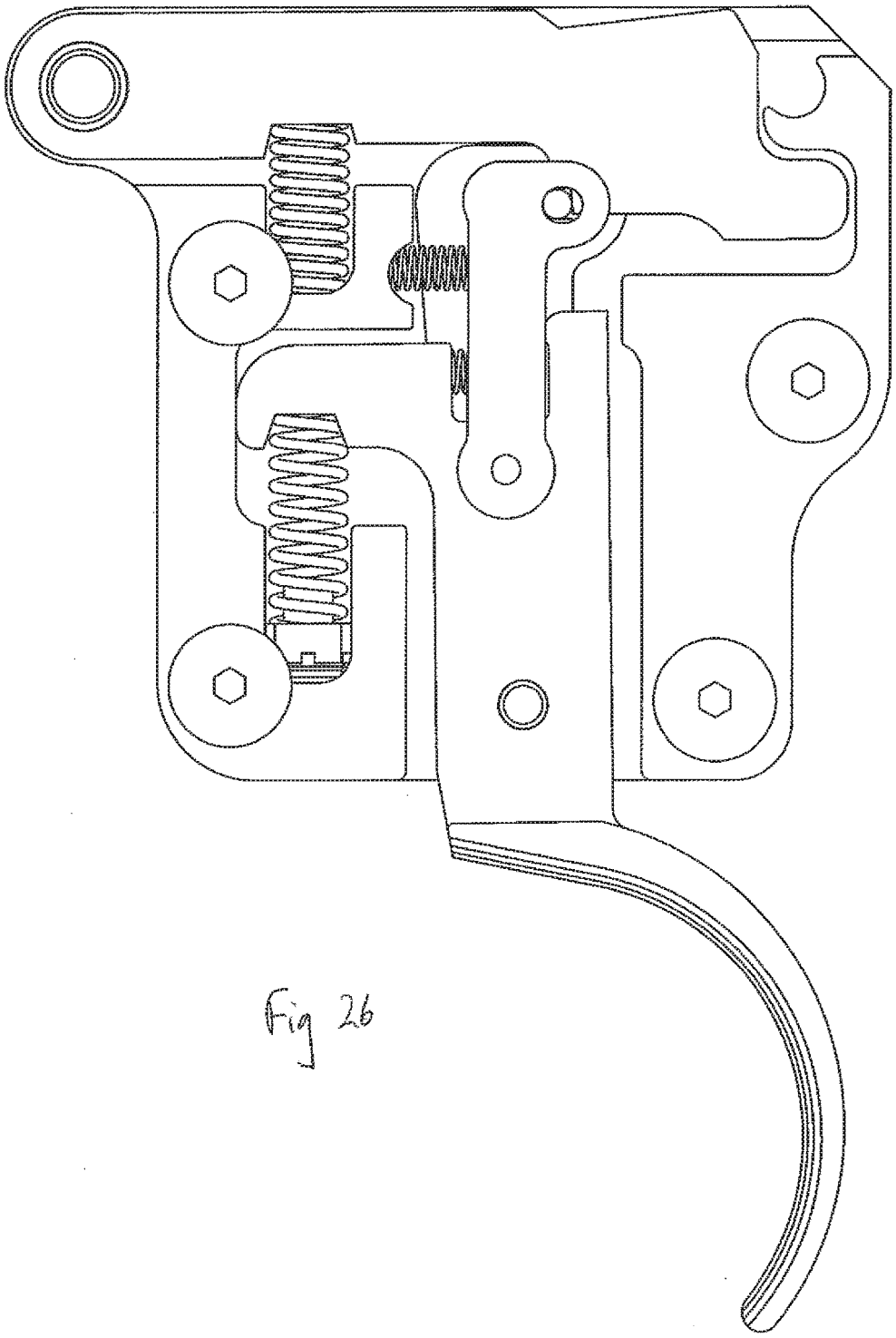

As another example, in another embodiment, the ticker biasing member 430 may be connected to the housing, rather than the trigger 120, as shown in FIG. 25. Similarly, in yet another embodiment, two ticker biasing members 430 may be used, one connected to the housing and the other connect to the trigger 120, as shown in FIG. 26.

The scope of the claims should not be limited by the preferred embodiments set forth in the examples but should be given the broadest interpretation consistent with the description as a whole.

What is claimed is:

1. A trigger device for activating a firing mechanism, the trigger device comprising:

a housing;

a trigger pivotally mounted on the housing via a trigger pivot pin;

a trigger biasing member configured to bias the trigger in a ready position;

a sear arm comprising a first sear surface;

a ticker extending generally from the trigger to the sear arm and rotatable about a ticker pivot pin, the ticker comprising spaced apart flanges defining a slot, the slot receiving a portion of the sear arm including the first sear surface, each flange comprising an aperture defining a first contact surface; and a captured roller positioned at least partially within the apertures and extending through the slot, the captured roller configured to selectively engage the first sear surface and the first contact surfaces.

2. The trigger device of claim 1 wherein the trigger comprises a trigger arm positioned above the trigger pivot pin.

3. The trigger device of claim 1 wherein the captured roller is configured to rotate and translate within the apertures when disengaged with the first contact surface.

4. The trigger device of claim 1 wherein the trigger is configured to hold a portion of the ticker.

5. The trigger device of claim 4 further comprising a biasing member biasing the ticker in a same direction as a direction of travel of the trigger from a ready position to a fire position.

6. The trigger device of claim 1 wherein the trigger is pivotable about the trigger pivot pint between a ready position, in which the trigger arm is not in contact with the housing, and a fire position, in which the trigger arm is in contact with the housing.

7. The trigger device of claim 6 wherein the ticker is pivotable about the ticker pivot pin between a first position, in which the trigger is in contact with the ticker, and a second position, in which the trigger is not in contact with the ticker, the ticker moveable from the first position to the second position as the trigger moves from the ready position towards the fire position.

8. The trigger device of claim 7 wherein the sear arm is moveable between a captured position, in which the sear arm is held by the engagement of the first sear surface with the captured roller, and a released position in which the first sear surface is disengaged with the captured roller.

9. The trigger device of claim 8 wherein the captured roller translates within the apertures as the sear arm moves from the captured position to the released position.

10. The trigger device of claim 1 wherein the ticker is rotatably coupled to the trigger.

11. A trigger device for activating a firing mechanism, the trigger device comprising:

a housing;

a trigger pivotally mounted on the housing via a trigger pivot pin;

a sear arm comprising a first sear surface;

a ticker extending generally from the trigger to the sear arm, the ticker pivotable about a ticker pivot pin, the ticker comprising spaced apart flanges, each of which comprises an aperture defining at least a first contact surface; and a captured roller positioned at least partially within the apertures, wherein in a captured position the first sear surface and the first contact surface engages the captured roller and in a released position the first contact surface disengages from the captured roller to allow the captured roller to move within the aperture.

12. The trigger device of claim 11 wherein the sear arm moves from the captured position to the released position upon movement of the trigger from a ready position to a fire position.

13. The trigger device of claim 12 wherein the ticker is pivotable about the ticket pivot pin between a first position, in which the trigger is in contact with the ticker, and a second position, in which the trigger is not in contact with the ticker, the ticker moveable from the first position to the second position upon movement of the trigger from the ready position to the fire position.

14. The trigger device of claim 11 wherein the captured roller is translatable within the apertures due to relative movement between the ticker and the sear arm.

15. The trigger device of claim 11 further comprising a trigger biasing member biasing the trigger in a direction towards the sear.

16. The trigger device of claim 15 wherein the trigger biasing member is adjustable.

17. The trigger device of claim 11 further comprising a sear biasing member biasing the sear in a direction away from the trigger.

18. The trigger device of claim 11 further comprising a ticker biasing member biasing the ticker in a same direction as a direction of travel of the trigger from the ready position to the fire position.

19. The trigger device of claim 11 further comprising a trigger arm engageable by a user to move the trigger from the ready position to the fire position thereby activating the firing mechanism.

20. The trigger device of claim 11 wherein the movement of the captured roller within the apertures is translation and rotation.

* * * * *